US010378232B2

(12) United States Patent
Volin

(10) Patent No.: US 10,378,232 B2
(45) Date of Patent: Aug. 13, 2019

(54) UNIQUE THREE-DIMENSIONALLY ADJUSTABLE AND ALIGNABLE ARTICULATING POST-SECURING SYSTEM, HAVING THREE-DIMENSIONALLY ADJUSTABLE AND ALIGNABLE BOLT SYSTEM AND STANCHION SYSTEM, AND OFFSET SPIRAL LOCKING SHOVEL SYSTEM AND BLADE SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 250 days.

(21) Appl. No.: 15/582,650

(22) Filed: Apr. 29, 2017

(65) Prior Publication Data

US 2017/0335590 A1 Nov. 23, 2017

Related U.S. Application Data

(60) Provisional application No. 62/330,136, filed on Apr. 30, 2016.

(51) Int. Cl.
*E04H 12/22* (2006.01)

(52) U.S. Cl.
CPC ..... *E04H 12/2261* (2013.01); *E04H 12/2284* (2013.01)

(58) Field of Classification Search
CPC ..... E04H 12/2261; E04H 12/2284; E04H 12/2253; E04H 12/2269; E04H 12/2276; E04H 12/2292; E04H 12/22; E04H 12/223; E02D 27/42; E02D 27/425; E02D 5/223; E02D 7/02; E02D 7/04; F16M 13/022; F16B 5/025; F16B 43/02; E01F 9/631
See application file for complete search history.

(56) References Cited

U.S. PATENT DOCUMENTS

| | | | |
|---|---|---|---|
| 1,153,450 | A | 9/1915 | Schaff |
| 1,268,167 | A | 6/1918 | Shoecraft |
| 1,334,812 | A | 3/1920 | Snow |
| 2,067,890 | A | 1/1937 | Collord |
| 2,086,213 | A | 7/1937 | Collord |
| 2,580,948 | A | 1/1952 | Pancake |
| 3,279,133 | A | 10/1966 | De Korte |
| 3,519,234 | A | 7/1970 | Matson |
| 3,606,222 | A | 9/1971 | Howard |
| 3,823,785 | A | 7/1974 | Toliver |

(Continued)

*Primary Examiner* — Christopher Garft

(57) ABSTRACT

A three-dimensionally-adjustable spike for securing a post comprises: two C-shaped walls, two wrench-accessible openings formed in the two C-shaped walls, a base molded to the two C-shaped walls, two post-elevating struts welded to the base, post-clamping screws screwed into the two C-shaped walls and the post, convex bolts each having a convex bolt bottom, concave upper washers each having an upper concave surface engaging with the convex bolt bottom, concave lower washers each having a lower concave surface, convex locking nuts each having a convex nut top engaging with the lower concave surface for three-dimensionally adjusting and securing the stanchion base and the post perpendicularly to the ground, a hammer plate, plate nuts welded to the hammer plate for stationarily securing the convex locking bolts to the hammer plate, spiral blades, offset spiral shovels, and a spike welded to the spiral blades, the offset spiral shovels, and the hammer plate.

11 Claims, 24 Drawing Sheets

(56) References Cited

U.S. PATENT DOCUMENTS 3,843,079 A 10/1974 Reisling
4,249,715 A 2/1981 Repp
4,378,650 A 4/1983 Ottoson
4,516,365 A * 5/1985 Chapman ..... E04H 12/2292 52/170
4,522,530 A 6/1985 Arthur
4,588,157 A 5/1986 Mills
4,874,149 A 10/1989 Miceli
D316,367 S 4/1991 Olson
5,090,656 A 2/1992 Brown
D325,870 S 5/1992 Niles
5,230,187 A 7/1993 Reimann
D349,434 S 8/1994 Archambeau
5,524,855 A 6/1996 Lesar
5,709,366 A 1/1998 Speece
5,884,874 A * 3/1999 Speece ..... E04H 12/2215 248/156
6,039,298 A 3/2000 Spier
6,272,798 B1 * 8/2001 Cockman ..... E02D 5/801 135/118
6,273,390 B1 8/2001 Meyer
7,219,872 B2 5/2007 Walker
D579,585 S 10/2008 Walker
7,472,874 B2 1/2009 Gross
7,500,919 B2 3/2009 Priegel
8,177,185 B2 5/2012 Priegel
8,322,678 B2 12/2012 Zhu
D679,457 S 4/2013 Chance
8,464,464 B2 6/2013 Rosaen
8,590,856 B2 11/2013 Zhu
8,938,900 B1 1/2015 Halle
9,212,501 B2 12/2015 Walker
9,238,922 B2 1/2016 Intagliata
2005/0188627 A1 * 9/2005 Alberts ..... E02D 5/801 52/166
2005/0279896 A1 12/2005 Callies
2009/0293379 A1 12/2009 Smith
2012/0192507 A1 * 8/2012 Paananen ..... E04H 12/2215 52/155
2013/0259600 A1 * 10/2013 Kerechanin, II ..... F16B 43/02 411/368
2014/0115978 A1 * 5/2014 Fairbairn ..... E02D 27/42 52/126.1
2018/0347173 A1 * 12/2018 Silva ..... E04B 2/78

* cited by examiner

Fig. 7A
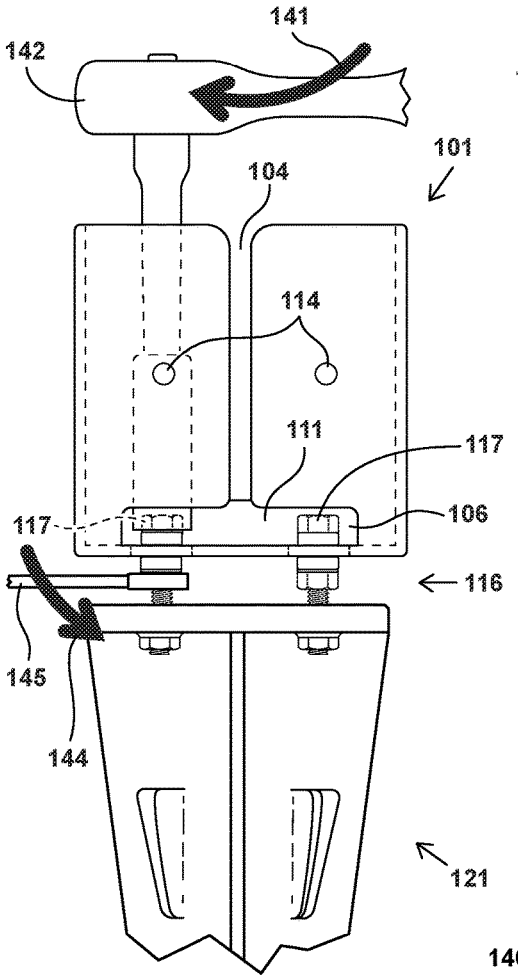
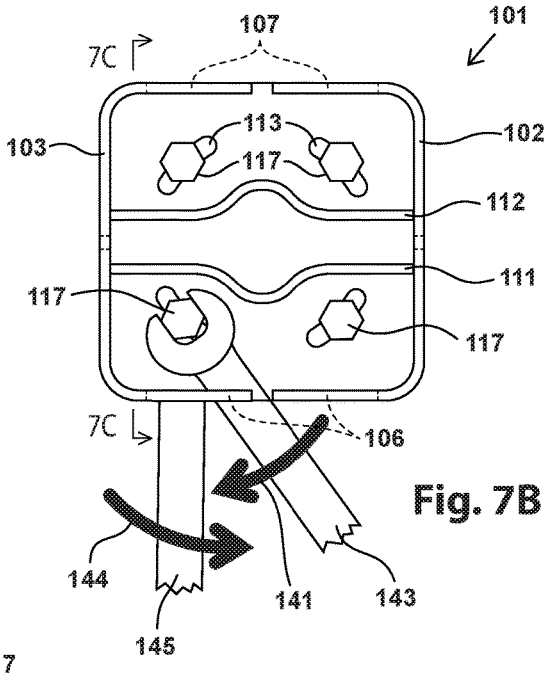
Fig. 7B
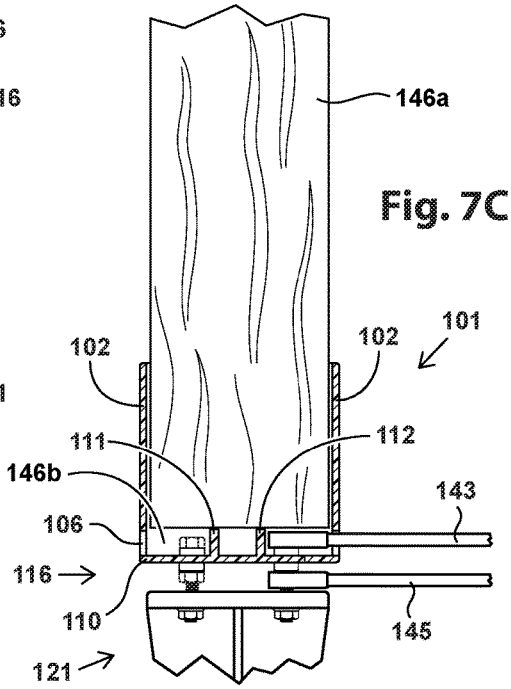
Fig. 7C

Fig. 8C
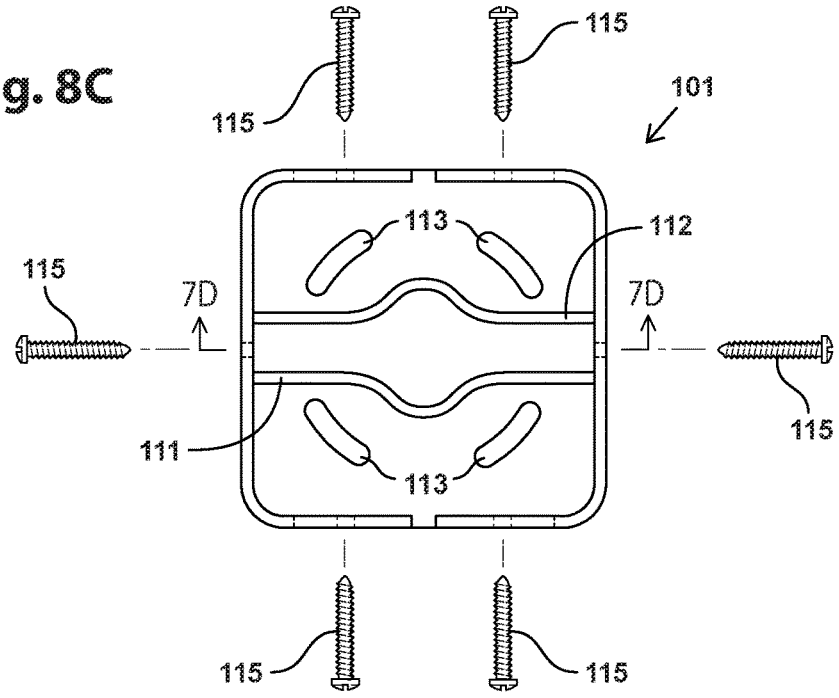
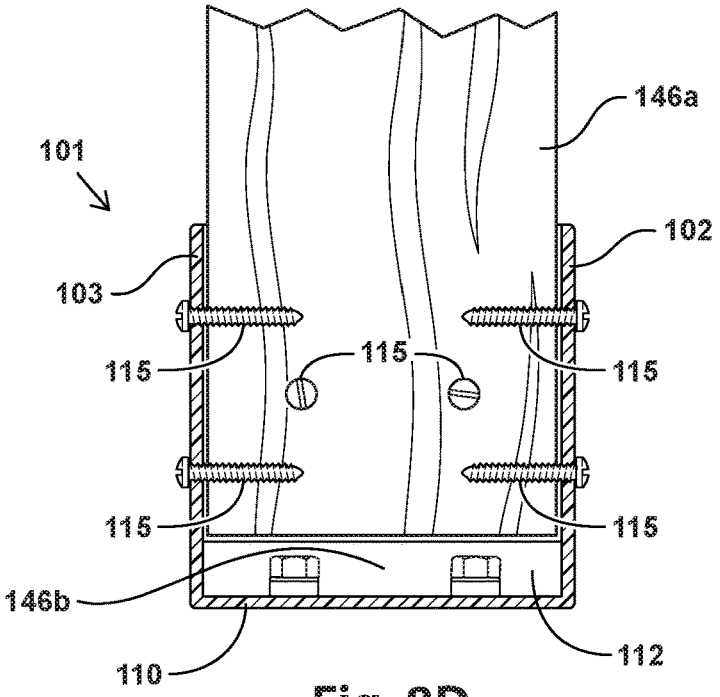
Fig. 8D

UNIQUE THREE-DIMENSIONALLY ADJUSTABLE AND ALIGNABLE ARTICULATING POST-SECURING SYSTEM, HAVING THREE-DIMENSIONALLY ADJUSTABLE AND ALIGNABLE BOLT SYSTEM AND STANCHION SYSTEM, AND OFFSET SPIRAL LOCKING SHOVEL SYSTEM AND BLADE SYSTEM

1. FIELD OF THE INVENTION

The present invention relates to a post-securing anchor, which is cheap to produce, is easy to ship as one unit, can quickly and easily be assembled and disassembled, and can quickly and easily be adjusted any time. Particularly, the present invention relates to a three-dimensionally-adjustable three-dimensionally-alignable articulating spike system for securing a post, having:

1) Three-dimensionally-adjustable three-dimensionally-alignable post-securing stanchion system,
2) Three-dimensionally-adjustable three-dimensionally-alignable stanchion-securing bolt system,
3) Multi-spiral-locking-blade multi-offset-spiral-locking-shovel ground-penetrating system, and
4) Rust-preventing stanchion-covering system.

2. DESCRIPTION OF THE PRIOR ART

A number of post-securing anchors have been introduced.

U.S. Pat. No. 1,153,450, issued 1915 Sep. 14, to S. R. Schaff, relates to certain improvements in land anchors, and more particularly to that type adapted for use in the anchoring of guy wires, for telephone poles, telegraph poles and other structures. This invention relates to one or more anchor blades carried thereby and moveable in respect to lie closely and adjacent to the body portion of the anchor.

U.S. Pat. No. 1,268,167, issued 1918 Jun. 4, to L. W. Shoecraft, details a novel section fence post which will facilitate the driving thereof into earth and to prevent the disorienting or mush-rooming of the upper end of the post; due to the force of the blows delivered to the same during driving operation.

U.S. Pat. No. 1,334,812, issued 1920 Mar. 23, to T. T. Snow, relates to a certain improvements in posts and an anchoring means therefor wherein the post is hollow or tubular and is provided in its walls at a point below the ground line of the post with openings through which are adapted to be extended anchoring members or leaves carried by a block capable of movement within the bore of the post.

U.S. Pat. No. 2,067,890, issued 1937 Jan. 19, to G. L. Collord, describes a once piece wholly metallic post useful as a fence post, as a highway guard post and various other purposes. As the post is formed it as above ground the tensile strength of the steel or wrought iron bar and has below ground resistance to corrosion of cast-iron.

U.S. Pat. No. 2,086,213, issued 1937 Jul. 6, to G. L. Collord, details a post, which is metallic and resistant to corrosion. It is taken directly from blast-furnace iron rather than cupola iron. It has a ferrous metal, maximum resistance to corrosion; but is a highly fragile metal.

U.S. Pat. No. 2,580,948, issued 1952 Jan. 1, to P. C. Pancake, refers to a anchoring device that can be inserted in the ground by a driving action and thereafter made secure by extending further into the ground anchoring elements as by a screwing action of a central shaft to which the anchoring elements are connected and operable within a pope that can be driven into the ground.

U.S. Pat. No. 3,279,133, issued 1966 Oct. 18, to J. F. De Korte, relates to boundary markers for driveways, lawns, golf greens and similar areas and in particular, to those boundary markers which return to the vertical position after being struck by a vehicle or other device.

U.S. Pat. No. 3,519,234, issued 1968 Jan. 18, to E. J. Howard, reveals a two-part post having a lower ground-penetrating part and an upper reciprocally mounted upper part that can be used selectively as hammer for driving the lower part into or out of the ground and having means for locking the two parts together against relative angular movement after the lower part is inserted into the ground so that display media attached to the upper part cannot be twisted out of viewable position.

U.S. Pat. No. 3,606,222, issued 1971 Sep. 20, to E. J. Howard, outlines a street sign support post driven completely into the ground, a second post bolted to said first pot and extending above the ground, and a third, sign-supporting post extending down over the second post to a point near the ground and carrying a street sign assembly at the top. The third post has notches in the lower end thereof.

U.S. Pat. No. 3,823,785, issued 1974 Jul. 16, to George W. Toliver, describes a light-weight, portable, self-driving support and anchor for parasols, umbrellas, flagpoles and other substantially vertical supporting elements for temporary structures, enclosures or decorative purposes, the support and anchor being characterized by its ability to be easily fixed, driven and firmly positioned without the use of extraneous tools in soils or ground of various degrees of compactness, including sandy beaches, sun-baked compacted soil and asphaltic cement pavements.

U.S. Pat. No. 3,843,079, issued 1974 Oct. 22, to David Charles Reisling, demonstrates a stand intended for holding the staff or shaft of a flag including a truncated hemispherical body member having a cylindrical bore formed integrally therein and opening out of the top surface thereof with a socket formed concentric therewith, the bottom of the bore being of an inverted conical configuration such that shafts of various diameters may be secured in the bore concentric therewith to project vertically out of the stand, the socket having securing means associated therewith and adapted to be operated by finger pressure of an individual's fingers to tighten the same against the shaft to secure the same in the stand, the colors of the stand being the same as the color of the flag being displayed.

U.S. Pat. No. 4,249,715, issued 1981 Feb. 10, to Garry E. Repp, refers to a sign mounting apparatus including a tubular post member. It is adapted to be mounted in a vertically oriented position. A horizontal member is attached to the post member and a mechanism is provided for removeably attaching the horizontal member to the tubular post member. Loops are on the horizontal member for attaching a sign to the horizontal member. A post driving mechanism is attached to the post member for securing the post to the ground by reciprocal movement of the post member and includes a closure member secured to the bottom end of the tubular post member and having a central opening therein.

U.S. Pat. No. 4,378,650, issued 1983 Apr. 5, to James A. Ottoson, refers to a signpost which comprises a base adapted for being driven into the ground, a vertical post member fitting over a portion of the base extending above the ground and into a collar on the base, and a horizontal post member from which a sign is attached being connected to the vertical post member. The base is easily removed from the ground by the use of a fulcrum and a lever arm to which a ring is attached. Placing the ring over the upper portion of the base and forcing down on the opposite end of the lever arm pulls the base from the ground.

U.S. Pat. No. 4,522,530, issued 1985 Jun. 11, to W. Eugene Arthur, relates to an elongated flexible tube of resilient plastics material including an upper end portion and a lower end portion and is capable of being repetitively bent through an angle of ninety degrees and of returning to an upright straight position with the aid of a flexible erecting member within the tube. The upper end portion may be thermally flattened for receiving a panel of reflective material or the reflective material may wrap around the tube.

U.S. Pat. No. 4,588,157, issued 1986 May 13, to Derek J. Mills, describes a post support comprising an elongate ground engaging portion, preferably a cruciform cross section, capable of being driven vertically into the ground, and a post engaging portion attached to the ground engaging portion and in the form of a hollow box section for receiving one end of a post to be supported in a vertical position and with its axis substantially parallel to the axis of the ground engaging portion, wherein the hollow box section is formed with means, integral therewith, other than means for adjusting the size of the box section, for enabling an undersized post to be rigidly supported in the box section and/or for removing excess post material from an oversized post.

U.S. Pat. No. 4,874,149, issued 1989 Oct. 17, to Daniel Miceli, defines a post support for securing a post in the ground in a generally vertical position, which post support comprises an elongated ground-engaging spike to be driven vertically into the ground and a post support hollow container which comprises a pair of fixed, right angle vertical wall sections which form a part of the hollow container and which have tapered hemmed edges and a pair of right angled wedge end caps which also have tapered hemmed edges.

U.S. Pat. No. 5,090,656, issued 1992 Feb. 25, to Roger A. Brown, pertains to a sign of fence post supports which includes an upper polygonal section from which depend a plurality of leg members. The upper section defines an inner socket within which a post bottom is placed and includes a plurality of inwardly directed tangs specifically formed to permit slicing into the material of a post bottom being urged into the socket, to provide a secure interlocking of a post to the support device.

U.S. Pat. No. 5,230,187, issued 1993 Jul. 27, to Lyall V. Reimann, outlines a stake (10, 80) is provided which can be used for edging gardens and lawns or for the formation of forms for concrete foundations and slabs. The stake (10, 80) is moulded from a synthetic plastic material and comprises a leading end (12) which is tapered for penetrating the ground and a trailing end (14) which is provided with a beam-receiving formation (16) thereon for receiving a beam therein.

U.S. Pat. No. 5,524,855, issued 1996 Jun. 11, to W. Eugene Arthur, describes an anchor for supporting an umbrella post in a vertical position relative to a ground surface. The inventive device includes a cylindrical main body positionable into the ground surface and having a cylindrical bore for receiving the umbrella post. The cylindrical body includes a shovel formed at a lower end thereof, and a storage cup secured to an upper end for receiving and storing small articles or the like.

U.S. Pat. No. 5,709,366, issued 1998 Jan. 20, to Stephen Speece, details a fence post support for securing a synthetic resin fence post in the ground in a vertical position. The fence post support comprises a ground engaging spike whose upper portion receives the end of the fence post thereover and which can be expanded wedgeably securing the post on the support. A pounding plate is provided for driving the post support into the ground.

U.S. Pat. No. 5,884,874, issued 1999 Mar. 23, to Stephen Speece, demonstrates a fence post anchor that adjusts for vertical post alignment by providing a post engagement support portion that swivels on a ground engagement portion. The post engagement portion is defined by a split box sleeve secured to an adjustment dome. A fastener assembly interconnects the adjustment dome to the ground engagement portion that has multiple engagement flights on which the dome can be movably positioned and secured thereto.

U.S. Pat. No. 6,039,298, issued 2000 Mar. 21, to Peter Spier, refers to a post support apparatus for retaining a mounting post in generally upright disposition and including an elongated support body which includes a lower stake portion adapted to be driven into the earth, and an upper or above-surface post receiving portion. The post receiving portion includes a cavity adapted to rigidly and clampingly retain the base of a post therewithin. The stake portion consists of a continuously tapered body of generally criss-cross or "X" configuration, having outer edge surfaces therealong, and with a distal tip end for engaging the earth and a proximal end for above-surface post retention.

U.S. Pat. No. 6,273,390, issued 2001 Aug. 14, to George Meyer, refers to a post holder that is formed by a lower spike portion and an upper bracket portion. The bracket portion is connected to the spike portion at an adjustable connection formed by a curved seat at the upper end of the spike portion and a curved base at the bottom end of the bracket portion.

U.S. Pat. No. 7,219,872, issued 2007 May 22, to Simon Walker, outlines a adjustable post support (10) for use in supporting a post vertically above the ground. The support may include a lower spike portion (12) and an upper bracket portion (14). The lower spike portion may include an upper end. The bracket portion may include a curved dome (22) and an upstanding sleeve (32) extending upwardly therefrom. The curved dome may nest with the upper end of the spike to provide a ball and socket type connection between the lower spike portion and the upper bracket portion.

U.S. Pat. No. 7,472,874, issued 2009 Jan. 6, to John Gross, describes a ground stake for securing ropes or other fastening elements which comprises a head portion with an elevated, textured surface and two or more extending flanges above a neck portion comprising recesses and a passageway. A plurality of elongated fins, at least a portion of which are tapered, depend from the base of the head portion and terminate in a truncated blunt end, providing a stronger tip while allowing clean penetration of the ground. One or more of the fins may comprise a stiffening rib to increase the rigidity of the fin.

U.S. Pat. No. 7,500,919, issued 2009 Mar. 10, to Jack C. Priegel, defines a mounting device for the end of a flag pole that provides an enhanced coupling of the pole within a golf cup is provided. The mounting device includes a securement rib that fastens to the pole without adhesive or secondary fasteners. The mounting device also includes features to minimize sticking to the golf cup and provides for a more upright presentation of the flag pole even in windy or breezing conditions.

U.S. Pat. No. 8,177,185, issued 2012 May 15, to Jack C. Priegel, describes a knock down flag pole assembly, and is provided including a base, a ferrule, and an elongate post. The base may include a coupling with a pocket having a coupling member or portion configured to removably couple to the ferrule. The coupling secures the ferrule to the base, but also permits the flag pole to be knocked out from the base.

U.S. Pat. No. 8,322,678, issued 2012 Dec. 4, to Jianzhong Thu, describes a metal post support ground spike is disclosed having a post receiving socket, and a flat plate. The flat plate is welded to four walls of the post receiving socket. The post support may also comprise a blades portion welded to the flat plate. The blades portion, post receiving socket and flat plate may all have reinforcement lines stamped therein and may comprise metals of varying thickness and rigidity.

U.S. Pat. No. 8,464,464, issued 2013 Jun. 18, to Lars Rosaen, pertains to an edging guide may include an anchor and a retailer that may be rotatably mounted to the anchor. The anchor may be buried in the ground during use and may include a post portion and a support portion. The retailer may be rotatably mounted to the support of the anchor and may function to secure hold one or more lengths of edging material.

U.S. Pat. No. 8,590,856, issued 2013 Nov. 26, to Joanzhong Zhu, details a metal post support ground spike that is disclosed having a post receiving socket, and a flat plate. The flat plate is welded to four walls of the post receiving socket. The post support may also comprise a blades portion welded to the flat plate. The blades portion, post receiving socket and flat plate may all have reinforcement lines stamped therein and may comprise metals of varying thickness and rigidity.

U.S. Pat. No. 8,938,900, issued 2015 Jan. 27, to John Halle, reveals a sign post system includes an elongated slide spike, and an impact anvil mounted to the slide spike at a location intermediate the spike ends. An elongated slide hammer column assembly slides onto the slide spike to contact the impact anvil while using the slide spike as a guide to deliver a force to the slide spike to drive the slide spike into the ground.

U.S. Pat. No. 9,212,501, issued 2015 Dec. 15, to David Eric Walker, outlines a pole mounting system that comprises a support mounting and a pole base. The support mounting has a receiving aperture that tapers conically inwardly from a receiving aperture, and at least one helical guide channel is formed in a wall of the receiving recess and extends axially away from the receiving aperture. Each guide channel has a terminal reverse bend.

U.S. Pat. No. 9,238,922, issued 2016 Jan. 19, to John Intagliata, pertains to a ground anchor for a delineator including a unitary plastic body having a receptacle shaped and configured for connection to a delineator post and a ground engaging portion extending from the receptacle along a longitudinal axis. The ground engaging portion includes a plurality of tapered blades. Delineator assemblies using the ground anchor, and methods of installing the ground anchor, are also provided.

U.S. Pat. No. D316,367, issued 1991-0423, to Donald O. Olson, depicts the ornamental design for ground stake for retaining irrigation conduit, as shown and described.

U.S. Pat. No. D325,870, issued 1992 May 5, to Rex B. Niles, depicts the ornamental design for a fabric holddown stake, as shown and described.

U.S. Pat. No. D349,434, issued 1994 Aug. 9, to Dave Archambeau, depicts the ornamental design for a plant stake, as shown and described.

U.S. Pat. No. D579,585, issued 2008 Oct. 28, to Simon Walker, depicts the ornamental design for an adjustable post support, as shown and described.

U.S. Pat. No. D679,457, issued 2013-0402, to Christopher E. Chance, depicts the ornamental design for a pet stake, as shown and described.

U.S. Patent No 20050279896, issued 2005 Dec. 22, to Gerald E. Callies, defines a post support having a post receiving box. The box includes a pair of adjacent sides having internally raised portions and a pair of opposite sides being free of such raised portions and being substantially open along one edge.

U.S. Patent No 20090293379, issued 2009 Dec. 3, to Ewan R. Smith, defines devices and systems comprising an anchor post that has a shaft, at least one stabilising element attached to the anchor post configured to resist movement of the anchor post, and at least one alignment element.

DISADVANTAGES OF THE PRIOR ART

The prior art have failed to solve many problems associated with such post-securing anchors, as follows:

1) No prior art mention or disclose any post-securing anchor, having a stanchion-securing bolt system, which has:
   - Convex locking bolts
   - Concave upper washers
   - Concave lower washers
   - Convex locking nuts.

Therefore, the prior art of post-securing anchor:
   - a) Can not uniquely and three-dimensionally be adjustable and lockable,
     to secure the stanchion base perpendicularly to the ground
     (FIGS. 4E, 4F, 4G, and 4H);
   - b) Can not uniquely and three-dimensionally be adjustable and lockable,
     to prevent posts and fences from:
     Leaning,
     Warping, and
     Twisting
     (FIGS. 1 Prior Art, 2 Prior Art, 8B, 8D, and 8E);
   - c) Can not provide a four-point base structure for the above girth of a fence post, flag pole, mail box or sign post
     (FIGS. 7A, 7B, 7C, 8A, 8B, 8C, 8D, and 8E);
   - d) Can not provide four locked stanchion-securing bolts, adding substantial resistance
     to above, supported fence post, flag pole, mail box, or sign post's swaying and movement
     (FIGS. 4G, 4H, 7B, 7C, 8A, 8B, 8C, 8D, and 8E);
   - e) Can not provide four locked stanchion bolts, adding longevity in preventing potential loosening
     (FIGS. 7A, 7B, 7C, 8A, 8B, 8D, and 8E); and
   - f) Can not provide four locked stanchion bolts, adding longevity in preventing potential failure
     (FIGS. 7A, 7B, 7C, 8A, 8B, 8C, 8D, and 8E).

2) No prior art mention or disclose any post-securing anchor, having a post-securing stanchion system.

Therefore, the prior art of post-securing anchor:
   - a) Can not be three-dimensionally adjustable and lockable
     (FIGS. 3A, 3B, 4A, 4B, 4C, 4G, 7A, 7B, and 7C);
   - b) Can not uniquely, secure a post perpendicularly to the ground
     (FIGS. 4E, 4F, 4G, and 4H); and
   - c) Can not uniquely, secure a vertical post for uses such as a fence post, flagpole, mailbox, road sign, real estate sign, etc.
     (FIGS. 4E, 4F, and 4H).

3) No prior art mention or disclose any post-securing anchor, having a post-securing stanchion system.
Therefore, the prior art of post-securing anchor:
a) Can not be three-dimensionally alignable and lockable
(FIGS. 3A, 3B, 4A, 4B, 4C, 4G, 7A, 7B, and 7C);
b) Can not uniquely, secure a post in line with other posts
(FIGS. 4E, 4F, 4G, and 4H);
c) Can not three-dimensionally align multiple posts within a fence-line, coursing up a hill
(FIGS. 1 Prior Art, 2 Prior Art, 4E, 4F, 4G, and 4H); and
d) Can not three-dimensionally align multiple posts within a fence-line, coursing up a stair-stepped incline
(FIGS. 4E, 4F, 4G, and 4H).

4) No prior art mention or disclose any post-securing anchor, having a post-securing stanchion system, which has:
An opening at its top
Two openings in its two post-clamping C-shaped walls.
Therefore, the prior art of post-securing anchor:
a) Can not uniquely and conveniently, access and adjust the stanchion-securing bolt system:
Through the opening at its top, and
Through the two openings in its two post-clamping C-shaped walls
(FIGS. 7A, 7B, 7C, 8A, and 8B);
b) Can not provide simple and convenient access to adjustment in subsequent years of use, as ground conditions change
to produce post misalignment
(FIGS. 2 Prior Art, 4E, 4F, 4G, and 4H);
c) Can not provide an adjustable opening and clamping capability to expandably accommodate multiple dimensions of posts
(FIGS. 8A, and 8B);
d) Can not provide a pleasing aesthetic with a smooth, cubical, architectural, outer structure, having no protruding hardware or bolts
(FIGS. 2 Prior Art, 4E, 4F, 4G, and 4H); and
e) Can not provide a pleasing aesthetic by having a three-dimensionally-adjustable three-dimensionally-alignable stanchion-securing bolt system hidden inward, and below two post-clamping C-shaped walls
(FIGS. 4D, 4G, 8A, 8B, 8C, 8D, and 8E).

5) No prior art mention or disclose any post-securing anchor, having a stanchion base.
Therefore, the prior art of post-securing anchor:
a) Can not have horizontal-angle-adjusting rotatable openings; and
(FIGS. 4E, 4F, 4G, and 4H);
b) Can not uniquely and horizontally, be rotatable and adjustable to be in line with other stanchion bases
(FIGS. 4E, 4F, 4G, and 4H).

6) No prior art mention or disclose any post-securing anchor, having a stanchion base, which has:
First post-elevating strut welded thereon for elevating and supporting a post bottom, to create an empty space between the post bottom and the stanchion base and the stanchion-securing bolt system; and
Second post-elevating strut welded thereon for elevating and supporting a post bottom, to create an empty space between the post bottom and the stanchion base and the stanchion-securing bolt system.
Therefore, the prior art of post-securing anchor:
a) Can not allow rainwater to evaporate away from the post bottom
(FIGS. 7A and 7C);
b) Can not keep the post bottom dry (FIG. 8B);
c) Can not prevent the post bottom from getting rotten
(FIGS. 8B and 8D);
d) Can not allow rain water to evaporate away from the stanchion base
(FIGS. 7A, 7B, 7C, 8D, and 8E);
e) Can not keep the stanchion base dry
(FIGS. 7A, 7B, 7C, 8A, 8B, 8C, 8D, and 8E);
f) Can not prevent the stanchion base from getting rusted
(FIGS. 7A, 7B, 7C, 8A, 8B, 8C, 8D, and 8E);
g) Can not allow rain water to evaporate away from the stanchion-securing bolt system
(FIGS. 7A, 7C, and 8B);
h) Can not keep the stanchion-securing bolt system dry
(FIG. 7C); and
i) Can not prevent the stanchion-securing bolt system from getting rusted
(FIGS. 7A, 7B, 7C, 8A, 8B, 8C, 8D, and 8E).

7) No prior art mention or disclose any post-securing anchor, having a stanchion base, which has horizontal-angle-adjusting rotatable openings.
Therefore, the prior art of post-securing anchor:
a) Can not allow rainwater to evaporate away from the post bottom
(FIGS. 7A and 7C);
b) Can not keep the post bottom dry (FIG. 8B);
c) Can not prevent the post bottom from getting rotten
(FIGS. 8B and 8D);
d) Can not allow rain water to evaporate away from the stanchion base
(FIGS. 7A, 7B, 7C, 8D, and 8E);
e) Can not keep the stanchion base dry
(FIGS. 7A, 7B, 7C, 8A, 8B, 8C, 8D, and 8E);
f) Can not prevent the stanchion base from getting rusted
(FIGS. 7A, 7B, 7C, 8A, 8B, 8C, 8D, and 8E);
g) Can not allow rain water to evaporate away from the stanchion-securing bolt system
(FIGS. 7A, 7C, and 8B);
h) Can not keep the stanchion-securing bolt system dry
(FIG. 7C); and
i) Can not prevent the stanchion-securing bolt system from getting rusted
(FIGS. 7A, 7B, 7C, 8A, 8B, 8C, 8D, and 8E).

8) No prior art mention or disclose any post-securing anchor, having a ground-penetrating system, which has:
Multiple spiral locking blades for piercing through the ground to create empty tracks behind; and
Multiple offset spiral locking shovels for shoveling the soil into the empty tracks made by the multiple spiral locking blades, to fill them up with soil to lock the multiple spiral locking blades in the ground.
Therefore, the prior art of post-securing anchor:
a) Can not uniquely and securely, lock the three-dimensionally-adjustable three-dimensionally-alignable articulating spike system in the ground
(FIGS. 4E, 4F, and 4H);
b) Can not uniquely and securely, lock the three-dimensionally-adjustable three-dimensionally-alignable articulating spike system into a sandy ground surface
(FIGS. 5A, 5B, 5C, 5D, and 5E);

c) Can not uniquely and securely, lock the three-dimensionally-adjustable three-dimensionally-alignable articulating spike system into a gravel surface (FIGS. 5A, 5B, 5C, 5D, 5E and 5D);

d) Can not uniquely and securely, lock the three-dimensionally-adjustable three-dimensionally-alignable articulating spike system into a rocky surface (FIGS. 5A, 5B, 5C, 5D, 5E and 5D);

e) Can not uniquely and securely, lock the three-dimensionally-adjustable three-dimensionally-alignable articulating spike system into an uneven surface (FIGS. 4B, 4C, 4F, 4G, and 4H);

f) Can not uniquely and securely, lock the three-dimensionally-adjustable three-dimensionally-alignable articulating spike system into an angled surface (FIGS. 4B, 4C, 4F, 4G, and 4H);

g) Can not uniquely and securely, lock the three-dimensionally-adjustable three-dimensionally-alignable articulating spike system into a ground surface having submerged, inconsistent rocks (FIGS. 1 Prior Art, 4E, 4F, and 4G); and h) Can not uniquely and securely, lock the three-dimensionally-adjustable three-dimensionally-alignable articulating spike system into a ground surface having submerged roots (FIGS. 1 Prior Art, 4E, 4F, and 4G).

9) No prior art mention or disclose any post-securing anchor, having convex locking bolts.

Therefore, the prior art of post-securing anchor:

a) Can not three-dimensionally adjust and align within one three-dimensionally-adjustable three-dimensionally-alignable concave upper washer (FIGS. 4A, 4B, 4C, 4E, 4F, and 4G);

b) Can not connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can not connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can not lock the three-dimensionally-adjustable three-dimensionally-alignable articulating spike system in the ground (FIGS. 3A, 4A, 4B, 4C, 4E, 4F, 6A, 6B, and 6C).

10) No prior art mention or disclose any post-securing anchor, having convex locking nuts.

Therefore, the prior art of post-securing anchor:

a) Can not three-dimensionally adjust and align within one three-dimensionally-adjustable three-dimensionally-alignable concave upper washer (FIGS. 4A, 4B, 4C, 4E, 4F, and 4G);

b) Can not connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can not connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can not lock the three-dimensionally-adjustable three-dimensionally-alignable articulating spike system in the ground (FIGS. 3A, 4A, 4B, 4C, 4E, 4F, 6A, 6B, and 6C).

11) No prior art mention or disclose any post-securing anchor, having first spiral locking blade.

Therefore, the prior art of post-securing anchor:

a) Can not spirally shovel soil into the piercing track made by first spiral locking blade to fill the piercing track up with soil to lock first spiral locking blade in the ground; (FIGS. 5A, 5B, 5C, 5D, 5E, and 5F);

b) Can not spirally lock multi-spiral-locking-blade multi-offset-spiral-locking-shovel ground penetrating system in the ground; (FIGS. 4E, 4F, 4G, 4H, 5B, 5C, 5D, and 5E);

c) Can not lock the three-dimensionally-adjustable three-dimensionally-alignable articulating spike system in the ground (FIGS. 4B, 4C, 4F, 4G, and 4H);

d) Can not uniquely, spirally lock the three-dimensionally-adjustable three-dimensionally-alignable articulating spike system into a sandy ground surface (FIGS. 5A, 5B, 5C, 5D, 5E, and 5F);

e) Can not uniquely, spirally lock the three-dimensionally-adjustable three-dimensionally-alignable articulating spike system into a gravel surface (FIGS. 4E, 4F, 4G, 4H, 5A, 6A, 6B, and 6C);

f) Can not uniquely, spirally lock the three-dimensionally-adjustable three-dimensionally-alignable articulating spike system into a rocky surface (FIGS. 4E, 4F, 4G, 4H, 6A, 6B, and 6C);

g) Can not uniquely, spirally lock the three-dimensionally-adjustable three-dimensionally-alignable articulating spike system into a uneven surface (FIGS. 4B, 4C, 4E, 4F, 4G, and 4H);

h) Can not uniquely, spirally lock the three-dimensionally-adjustable three-dimensionally-alignable articulating spike system into a angled surface (FIGS. 4E, 4F, 4G, and 4H);

i) Can not uniquely, spirally lock the three-dimensionally-adjustable three-dimensionally-alignable articulating spike system into a ground surface having submerged, inconsistent rocks (FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots (FIGS. 4E, 4F, 4G, and 4H).

12) No prior art mention or disclose any post-securing anchor, having second spiral locking blade.

Therefore, the prior art of post-securing anchor:

a) Can not spirally shovel soil into the piercing track made by first spiral locking blade to fill the piercing track up with soil to lock first spiral locking blade in the ground (FIGS. 5A, 5B, 5C, 5D, 5E, and 5F);

b) Can not spirally lock multi-spiral-locking-blade multi-offset-spiral-locking-shovel ground penetrating system in the ground
(FIGS. 4E, 4F, 4G, 4H, 5B, 5C, 5D, and 5E);

c) Can not lock the three-dimensionally-adjustable three-dimensionally-alignable articulating spike system in the ground
(FIGS. 4B, 4C, 4F, 4G, and 4H);

d) Can not uniquely, spirally lock the three-dimensionally-adjustable three-dimensionally-alignable articulating spike system into a sandy ground surface
(FIGS. 5A, 5B, 5C, 5D, 5E, and 5F);

e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can not uniquely, spirally lock the three-dimensionally-adjustable three-dimensionally-alignable articulating spike system into a rocky surface
(FIGS. 4E, 4F, 4G, 4H, 6A, 6B, and 6C);

g) Can not uniquely, spirally lock the three-dimensionally-adjustable three-dimensionally-alignable articulating spike system into a uneven surface (FIGS. 4B, 4C, 4E, 4F, 4G, and 4H);

h) Can not uniquely, spirally lock the three-dimensionally-adjustable three-dimensionally-alignable articulating spike system into a angled surface
(FIGS. 4E, 4F, 4G, and 4H);

i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots
(FIGS. 4E, 4F, 4G, and 4H).

13) No prior art mention or disclose any post-securing anchor,
having third spiral locking blade.
Therefore, the prior art of post-securing anchor:

a) Can not spirally shovel soil into the piercing track made by first spiral locking blade to fill the piercing track up with soil to lock first spiral locking blade in the ground
(FIGS. 5A, 5B, 5C, 5D, 5E, and 5F);

b) Can not spirally lock multi-spiral-locking-blade multi-offset-spiral-locking-shovel ground penetrating system in the ground
(FIGS. 4E, 4F, 4G, 4H, 5B, 5C, 5D, and 5E);

c) Can not lock the three-dimensionally-adjustable three-dimensionally-alignable articulating spike system in the ground
(FIGS. 4B, 4C, 4F, 4G, and 4H);

d) Can not uniquely, spirally lock the three-dimensionally-adjustable three-dimensionally-alignable articulating spike system into a sandy ground surface
(FIGS. 5A, 5B, 5C, 5D, 5E, and 5F);

e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can not uniquely, spirally lock the three-dimensionally-adjustable three-dimensionally-alignable articulating spike system into a rocky surface
(FIGS. 4E, 4F, 4G, 4H, 6A, 6B, and 6C);

g) Can not uniquely, spirally lock the three-dimensionally-adjustable three-dimensionally-alignable articulating spike system into a uneven surface
(FIGS. 4B, 4C, 4E, 4F, 4G, and 4H);

h) Can not uniquely, spirally lock the three-dimensionally-adjustable three-dimensionally-alignable articulating spike system into a angled surface
(FIGS. 4E, 4F, 4G, and 4H);

i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots
(FIGS. 4E, 4F, 4G, and 4H).

14) No prior art mention or disclose any post-securing anchor,
having fourth spiral locking blade.
Therefore, the prior art of post-securing anchor:

a) Can not spirally shovel soil into the piercing track made by first spiral locking blade to fill the piercing track up with soil to lock first spiral locking blade in the ground
(FIGS. 5A, 5B, 5C, 5D, 5E, and 5F);

b) Can not spirally lock multi-spiral-locking-blade multi-offset-spiral-locking-shovel ground penetrating system in the ground
(FIGS. 4E, 4F, 4G, 4H, 5B, 5C, 5D, and 5E);

c) Can not lock the three-dimensionally-adjustable three-dimensionally-alignable articulating spike system in the ground
(FIGS. 4B, 4C, 4F, 4G, and 4H);

d) Can not uniquely, spirally lock the three-dimensionally-adjustable three-dimensionally-alignable articulating spike system into a sandy ground surface
(FIGS. 5A, 5B, 5C, 5I), 5E, and 5F);

e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can not uniquely, spirally lock the three-dimensionally-adjustable three-dimensionally-alignable articulating spike system into a rocky surface
(FIGS. 4E, 4F, 4G, 4H, 6A, 6B, and 6C);

g) Can not uniquely, spirally lock the three-dimensionally-adjustable three-dimensionally-alignable articulating spike system into a uneven surface
(FIGS. 4B, 4C, 4E, 4F, 4G, and 4H);

h) Can not uniquely, spirally lock the three-dimensionally-adjustable three-dimensionally-alignable articulating spike system into a angled surface
(FIGS. 4E, 4F, 4G, and 4H);

i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots
(FIGS. 4E, 4F, 4G, and 4H).

15) No prior art mention or disclose any post-securing anchor,
having first offset spiral locking shovel.
Therefore, the prior art of post-securing anchor:
a) Can not spirally shovel soil into the piercing track made by first spiral locking blade to fill the piercing track up with soil to lock first spiral locking blade in the ground
(FIGS. 5A, 5B, 5C, 5D, 5E, and 5F);
b) Can not spirally lock multi-spiral-locking-blade multi-offset-spiral-locking-shovel ground penetrating system in the ground;
(FIGS. 4E, 4F, 4G, 4H, 5B, 5C, 5D, and 5E);
c) Can not lock the three-dimensionally-adjustable three-dimensionally-alignable articulating spike system in the ground
(FIGS. 4B, 4C, 4F, 4G, and 4H);
d) Can not uniquely, spirally lock the three-dimensionally-adjustable three-dimensionally-alignable articulating spike system into a sandy ground surface
(FIGS. 5A, 5B, 5C, 5D, 5E, and 5F);
e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can not uniquely, spirally lock the three-dimensionally-adjustable three-dimensionally-alignable articulating spike system into a rocky surface
(FIGS. 4E, 4F, 4G, 4H, 6A, 6B, and 6C);
g) Can not uniquely, spirally lock the three-dimensionally-adjustable three-dimensionally-alignable articulating spike system into a uneven surface
(FIGS. 4B, 4C, 4E, 4F, 4G, and 4H);
h) Can not uniquely, spirally lock the three-dimensionally-adjustable three-dimensionally-alignable articulating spike system into a angled surface
(FIGS. 4E, 4F, 4G, and 4H);
i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can not uniquely, spirally lock the three-dimensionally-adjustable three-dimensionally-alignable articulating spike system into a ground surface having submerged roots
(FIGS. 4E, 4F, 4G, and 4H).

16) No prior art mention or disclose any post-securing anchor,
having second offset spiral locking shovel.
Therefore, the prior art of post-securing anchor:
a) Can not spirally shovel soil into the piercing track made by first spiral locking blade to fill the piercing track up with soil to lock first spiral locking blade in the ground
(FIGS. 5A, 5B, 5C, 5D, 5E, and 5F);
b) Can not spirally lock multi-spiral-locking-blade multi-offset-spiral-locking-shovel ground penetrating system in the ground
(FIGS. 4E, 4F, 4G, 4H, 5B, 5C, 5D, and 5E);
c) Can not lock the three-dimensionally-adjustable three-dimensionally-alignable articulating spike system in the ground
(FIGS. 4B, 4C, 4F, 4G, and 4H);
d) Can not uniquely, spirally lock the three-dimensionally-adjustable three-dimensionally-alignable articulating spike system into a sandy ground surface
(FIGS. 5A, 5B, 5C, 5D, 5E, and 5F);
e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can not uniquely, spirally lock the three-dimensionally-adjustable three-dimensionally-alignable articulating spike system into a rocky surface
(FIGS. 4E, 4F, 4G, 4H, 6A, 6B, and 6C);
g) Can not uniquely, spirally lock the three-dimensionally-adjustable three-dimensionally-alignable articulating spike system into a uneven surface
(FIGS. 4B, 4C, 4E, 4F, 4G, and 4H);
h) Can not uniquely, spirally lock the three-dimensionally-adjustable three-dimensionally-alignable articulating spike system into a angled surface
(FIGS. 4E, 4F, 4G, and 4H);
i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can not uniquely, spirally lock the three-dimensionally-adjustable three-dimensionally-alignable articulating spike system into a ground surface having submerged roots
(FIGS. 4E, 4F, 4G, and 4H).

17) No prior art mention or disclose any post-securing anchor,
having a post-securing stanchion system.
Therefore, the prior art of post-securing anchor:
a) Can not spirally shovel soil into the piercing track made by first spiral locking blade to fill the piercing track up with soil to lock first spiral locking blade in the ground
(FIGS. 5A, 5B, 5C, 5D, 5E, and 5F);
b) Can not spirally lock multi-spiral-locking-blade multi-offset-spiral-locking-shovel ground penetrating system in the ground
(FIGS. 4E, 4F, 4G, 4H, 5B, 5C, 5D, and 5E);
c) Can not lock the three-dimensionally-adjustable three-dimensionally-alignable articulating spike system in the ground
(FIGS. 4B, 4C, 4F, 4G, and 4H);
d) Can not uniquely, spirally lock the three-dimensionally-adjustable three-dimensionally-alignable articulating spike system into a sandy ground surface
(FIGS. 5A, 5B, 5C, 5D, 5E, and 5F);
e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can not uniquely, spirally lock the three-dimensionally-adjustable three-dimensionally-alignable articulating spike system into a rocky surface
(FIGS. 4E, 4F, 4G, 4H, 6A, 6B, and 6C);
g) Can not uniquely, spirally lock the three-dimensionally-adjustable three-dimensionally-alignable articulating spike system into a uneven surface
(FIGS. 4B, 4C, 4E, 4F, 4G, and 4H);
h) Can not uniquely, spirally lock the three-dimensionally-adjustable three-dimensionally-alignable articulating spike system into a angled surface
(FIGS. 4E, 4F, 4G, and 4H);

i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots
(FIGS. 4E, 4F, 4G, and 4H).

18) No prior art mention or disclose any post-securing anchor,
having a post-securing stanchion system.
Therefore, the prior art of post-securing anchor:

a) Can not spirally shovel soil into the piercing track made by first spiral locking blade to fill the piercing track up with soil to lock first spiral locking blade in the ground
(FIGS. 5A, 5B, 5C, 5D, 5E, and 5F);

b) Can not spirally lock multi-spiral-locking-blade multi-offset-spiral-locking-shovel ground penetrating system in the ground
(FIGS. 4E, 4F, 4G, 4H, 5B, 5C, 5D, and 5E);

c) Can not lock the three-dimensionally-adjustable three-dimensionally-alignable articulating spike system in the ground
(FIGS. 4B, 4C, 4F, 4G, and 4H);

d) Can not uniquely, spirally lock the three-dimensionally-adjustable three-dimensionally-alignable articulating spike system into a sandy ground surface
(FIGS. 5A, 5B, 5C, 5D, 5E, and 5F);

e) Can not uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can not uniquely, spirally lock the three-dimensionally-adjustable three-dimensionally-alignable articulating spike system into a rocky surface
(FIGS. 4E, 4F, 4G, 4H, 6A, 6B, and 6C);

g) Can not uniquely, spirally lock the three-dimensionally-adjustable three-dimensionally-alignable articulating spike system into a uneven surface
(FIGS. 4B, 4C, 4E, 4F, 4G, and 4H);

h) Can not uniquely, spirally lock the three-dimensionally-adjustable three-dimensionally-alignable articulating spike system into a angled surface
(FIGS. 4E, 4F, 4G, and 4H);

i) Can not uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can not uniquely, spirally lock the three-dimensionally-adjustable three-dimensionally-alignable articulating spike system into a ground surface having submerged roots
(FIGS. 4E, 4F, 4G, and 4H).

OBJECTS AND ADVANTAGES OF THE INVENTION

The present invention substantially departs from the conventional concepts and designs of the prior art. In doing so, the present invention provides a three-dimensionally-adjustable three-dimensionally-alignable articulating spike system for securing a post (having: a) Three-dimensionally-adjustable three-dimensionally-alignable post-securing stanchion system, b) Three-dimensionally-adjustable three-dimensionally-alignable stanchion-securing bolt system, c) Multi-spiral-locking-blade multi-offset-spiral-locking-shovel ground-penetrating system, and d) Rust-preventing stanchion-covering system), having many unique and significant features, functions, and advantages, which overcome all the disadvantages of the prior art, as follows:

1) It is an object of the present invention to provide a three-dimensionally-adjustable three-dimensionally-alignable articulating spike system for securing a post, having a stanchion-securing bolt system, which has:
Convex locking bolts
Concave upper washers
Concave lower washers
Convex locking nuts.
Therefore, the three-dimensionally-adjustable three-dimensionally-alignable articulating spike system for securing a post:

a) Can uniquely and three-dimensionally be adjustable and lockable,
to secure the stanchion base perpendicularly to the ground
(FIGS. 4E, 4F, 4G, and 4H);

b) Can uniquely and three-dimensionally be adjustable and lockable,
to prevent posts and fences from:
Leaning,
Warping, and
Twisting
(FIGS. 1 Prior Art, 2 Prior Art, 8B, 8D, and 8E);

c) Can provide a four-point base structure for the above girth of a fence post, flag pole, mail box or sign post
(FIGS. 7A, 7B, 7C, 8A, 8B, 8C, 8D, and 8E);

d) Can provide four locked stanchion-securing bolts, adding substantial resistance
to above, supported fence post, flag pole, mail box, or sign post's swaying and movement
(FIGS. 4G, 4H, 7B, 7C, 8A, 8B, 8C, 8D, and 8E);

e) Can provide four locked stanchion bolts, adding longevity in preventing potential loosening
(FIGS. 7A, 7B, 7C, 8A, 8B, 8D, and 8E); and f) Can provide four locked stanchion bolts, adding longevity in preventing potential failure
(FIGS. 7A, 7B, 7C, 8A, 8B, 8C, 8D, and 8E).

2) It is another object of the present invention to provide a three-dimensionally-adjustable three-dimensionally-alignable articulating spike system for securing a post, having a post-securing stanchion system.
Therefore, the three-dimensionally-adjustable three-dimensionally-alignable articulating spike system for securing a post:

a) Can be three-dimensionally adjustable and lockable
(FIGS. 3A, 3B, 4A, 4B, 4C, 4G, 7A, 7B, and 7C);

b) Can uniquely, secure a post perpendicularly to the ground
(FIGS. 4E, 4F, 4G, and 4H); and c) Can uniquely, secure a vertical post for uses such as a fence post, flagpole, mailbox, road sign, real estate sign, etc.
(FIGS. 4E, 4F, and 4H).

3) It is a further object of the present invention to provide a three-dimensionally-adjustable three-dimensionally-alignable articulating spike system for securing a post, having a post-securing stanchion system.
Therefore, the three-dimensionally-adjustable three-dimensionally-alignable articulating spike system for securing a post:

a) Can be three-dimensionally alignable and lockable (FIGS. 3A, 3B, 4A, 4B, 4C, 4G, 7A, 7B, and 7C);
b) Can uniquely, secure a post in line with other posts; (FIGS. 4E, 4F, 4G, and 4H);
c) Can three-dimensionally align multiple posts within a fence-line, coursing up a hill (FIGS. 1 Prior Art, 2 Prior Art, 4E, 4F, 4G, and 4H); and
d) Can three-dimensionally align multiple posts within a fence-line, coursing up a stair-stepped incline (FIGS. 4E, 4F, 4G, and 4H).

4) It is yet another object of the present invention to provide a three-dimensionally-adjustable three-dimensionally-alignable articulating spike system for securing a post, having a post-securing stanchion system, which has:
An opening at its top
Two openings in its two post-clamping C-shaped walls.
Therefore, the three-dimensionally-adjustable three-dimensionally-alignable articulating spike system for securing a post:
a) Can uniquely and conveniently, access and adjust the stanchion-securing bolt system:
Through the opening at its top, and
Through the two openings in its two post-clamping C-shaped walls
(FIGS. 7A, 7B, 7C, 8A, and 8B);
b) Can provide simple and convenient access to adjustment in subsequent years of use, as ground conditions change
to produce post misalignment
(FIGS. 2 Prior Art, 4E, 4F, 4G, and 4H);
c) Can provide an adjustable opening and clamping capability to expandably accommodate multiple dimensions of posts (FIGS. 8A, and 8B);
d) Can provide a pleasing aesthetic with a smooth, cubical, architectural, outer structure, having no protruding hardware or bolts
(FIGS. 2 Prior Art, 4E, 4F, 4G, and 4H); and
e) Can provide a pleasing aesthetic by having a three-dimensionally-adjustable three-dimensionally-alignable stanchion-securing bolt system hidden inward, and below two post-clamping C-shaped walls
(FIGS. 4D, 4G, 8A, 8B, 8C, 8D, and 8E).

5) It is an even further object of the present invention to provide a three-dimensionally-adjustable three-dimensionally-alignable articulating spike system for securing a post,
having a stanchion base.
Therefore, the three-dimensionally-adjustable three-dimensionally-alignable articulating spike system for securing a post:
a) Can have horizontal-angle-adjusting rotatable openings; and
(FIGS. 3A, 3B, 3C, 4A, 4B, and 4C); and
b) Can uniquely and horizontally, be rotatable and adjustable
to be in line with other stanchion bases
(FIGS. 4E, 4F, 4G, and 4H).

6) It is still yet another object of the present invention to provide a three-dimensionally-adjustable three-dimensionally-alignable articulating spike system for securing a post,
having a stanchion base, which has:
First post-elevating strut welded thereon for elevating and supporting a post bottom, to create an empty space between the post bottom and the stanchion base and the stanchion-securing bolt system
(FIGS. 8C and 8D); and
Second post-elevating strut welded thereon for elevating and supporting a post bottom, to create an empty space between the post bottom and the stanchion base and the stanchion-securing bolt system
(FIGS. 8C and 8D).
Therefore, the three-dimensionally-adjustable three-dimensionally-alignable articulating spike system for securing a post:
a) Can allow rainwater to evaporate away from the post bottom
(FIGS. 7A and 7C);
b) Can keep the post bottom dry (FIG. 8B);
c) Can prevent the post bottom from getting rotten
(FIGS. 8B and 8D);
d) Can allow rainwater to evaporate away from the stanchion base
(FIGS. 7A, 7B, 7C, 8D, and 8E);
e) Can keep the stanchion base dry
(FIGS. 7A, 7B, 7C, 8A, 8B, 8C, 8D, and 8E);
f) Can prevent the stanchion base from getting rusted
(FIGS. 7A, 7B, 7C, 8A, 8B, 8C, 8D, and 8E);
g) Can allow rainwater to evaporate away from the stanchion-securing bolt system
(FIGS. 7A, 7C, and 8B);
h) Can keep the stanchion-securing bolt system dry
(FIG. 7C); and
i) Can prevent the stanchion-securing bolt system from getting rusted
(FIGS. 7A, 7B, 7C, 8A, 8B, 8C, 8D, and 8E).

7) It is still yet an even further object of the present invention to provide a three-dimensionally-adjustable three-dimensionally-alignable articulating spike system for securing a post,
having a stanchion base, which has horizontal-angle-adjusting rotatable openings.
Therefore, the three-dimensionally-adjustable three-dimensionally-alignable articulating spike system for securing a post:
a) Can allow rain water to evaporate away from the post bottom
(FIGS. 7A and 7C);
b) Can keep the post bottom dry
(FIG. 8B);
c) Can prevent the post bottom from getting rotten
(FIGS. 8B and 8D);
d) Can allow rain water to evaporate away from the stanchion base
(FIGS. 7A, 7B, 7C, 8D, and 8E);
e) Can keep the stanchion base dry
(FIGS. 7A, 7B, 7C, 8A, 8B, 8C, 8D, and 8E);
f) Can prevent the stanchion base from getting rusted
(FIGS. 7A, 7B, 7C, 8A, 8B, 8C, 8D, and 8E);
g) Can allow rain water to evaporate away from the stanchion-securing bolt system
(FIGS. 7A, 7C, and 8B);
h) Can keep the stanchion-securing bolt system dry
(FIG. 7C); and
i) Can prevent the stanchion-securing bolt system from getting rusted
(FIGS. 7A, 7B, 7C, 8A, 8B, 8C, 8D, and 8E).

8) It is still yet an even further object of the present invention to provide a three-dimensionally-adjustable three-dimensionally-alignable articulating spike system for securing a post, having a ground-penetrating system, which has:

Multiple spiral locking blades for piercing through the ground to create empty tracks behind; and Multiple offset spiral locking shovels for shoveling the soil into the empty tracks made by the multiple spiral locking blades, to fill them up with soil to lock the multiple spiral locking blades in the ground.

Therefore, the three-dimensionally-adjustable three-dimensionally-alignable articulating spike system for securing a post:

a) Can uniquely and securely, lock the three-dimensionally-adjustable three-dimensionally-alignable articulating spike system in the ground (FIGS. 4E, 4F, and 4H);

b) Can uniquely and securely, lock the three-dimensionally-adjustable three-dimensionally-alignable articulating spike system into a sandy ground surface (FIGS. 5A, 5B, 5C, 5D, and 5E);

c) Can uniquely and securely, lock the three-dimensionally-adjustable three-dimensionally-alignable articulating spike system into a gravel surface (FIGS. 5A, 5B, 5C, 5D, 5E and 5D);

d) Can uniquely and securely, lock the three-dimensionally-adjustable three-dimensionally-alignable articulating spike system into a rocky surface (FIGS. 5A, 5B, 5C, 5D, 5E and 5D);

e) Can uniquely and securely, lock the three-dimensionally-adjustable three-dimensionally-alignable articulating spike system into an uneven surface (FIGS. 4B, 4C, 4F, 4G, and 4H);

f) Can uniquely and securely, lock the three-dimensionally-adjustable three-dimensionally-alignable articulating spike system into an angled surface (FIGS. 4B, 4C, 4F, 4G, and 4H);

g) Can uniquely and securely, lock the three-dimensionally-adjustable three-dimensionally-alignable articulating spike system into a ground surface having submerged, inconsistent rocks (FIGS. 1 Prior Art, 4E, 4F, and 4G); and h) Can uniquely and securely, lock the three-dimensionally-adjustable three-dimensionally-alignable articulating spike system into a ground surface having submerged roots (FIGS. 1 Prior Art, 4E, 4F, and 4G).

9) It is still yet an even further object of the present invention to provide a three-dimensionally-adjustable three-dimensionally-alignable articulating spike system for securing a post, having convex locking bolts.

Therefore, the three-dimensionally-adjustable three-dimensionally-alignable articulating spike system for securing a post:

a) Can three-dimensionally adjust and align within one three-dimensionally-adjustable three-dimensionally-alignable concave upper washer (FIGS. 4A, 4B, 4C, 4E, 4F, and 4G);

b) Can connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can lock the three-dimensionally-adjustable three-dimensionally-alignable articulating spike system in the ground (FIGS. 3A, 4A, 4B, 4C, 4E, 4F, and 4G).

10) It is still yet an even further object of the present invention to provide a three-dimensionally-adjustable three-dimensionally-alignable articulating spike system for securing a post, having convex locking nuts.

Therefore, the three-dimensionally-adjustable three-dimensionally-alignable articulating spike system for securing a post:

a) Can three-dimensionally adjust and align within one three-dimensionally-adjustable three-dimensionally-alignable concave upper washer (FIGS. 4A, 4B, 4C, 4E, 4F, and 4G);

b) Can connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can lock the three-dimensionally-adjustable three-dimensionally-alignable articulating spike system in the ground (FIGS. 3A, 4A, 4B, 4C, 4E, 4F, 6A, 6B, and 6C).

11) It is still yet an even further object of the present invention to provide a three-dimensionally-adjustable three-dimensionally-alignable articulating spike system for securing a post, having a first spiral locking blade.

Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground; (FIGS. 5A, 5B, 5C, 5D, 5E, and 5F);

b) Can spirally lock multi-spiral-locking-blade multi-offset-spiral-locking-shovel ground penetrating system in the ground (FIGS. 4E, 4F, 4G, 4H, 5B, 5C, 5D, and 5E);

c) Can lock the three-dimensionally-adjustable three-dimensionally-alignable articulating spike system in the ground (FIGS. 4B, 4C, 4F, 4G, and 4H);

d) Can uniquely, spirally lock the three-dimensionally-adjustable three-dimensionally-alignable articulating spike system into a sandy ground surface (FIGS. 5A, 5B, 5C, 5D, 5E, and 5F);

e) Can uniquely, spirally lock the three-dimensionally-adjustable three-dimensionally-alignable articulating spike system into a gravel surface (FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

12) It is still yet an even further object of the present invention to provide a three-dimensionally-adjustable three-dimensionally-alignable articulating spike system for securing a post,
having a second spiral locking blade.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

13) It is still yet an even further object of the present invention to provide a three-dimensionally-adjustable three-dimensionally-alignable articulating spike system for securing a post,
having a third spiral locking blade.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground;
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

14) It is still yet an even further object of the present invention to provide a three-dimensionally-adjustable three-dimensionally-alignable articulating spike system for securing a post,
having a fourth spiral locking blade.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);
h) Can uniquely, spirally lock the three-dimensionally-adjustable three-dimensionally-alignable articulating spike system into a angled surface
(FIGS. 4E, 4F, 4G, and 4H);
i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can uniquely, spirally lock the three-dimensionally-adjustable three-dimensionally-alignable articulating spike system into a ground surface having submerged roots
(FIGS. 4E, 4F, 4G, and 4H).

15) It is still yet an even further object of the present invention to provide a three-dimensionally-adjustable three-dimensionally-alignable articulating spike system for securing a post,
having a first offset spiral locking shovel.
Therefore, the three-dimensionally-adjustable three-dimensionally-alignable articulating spike system for securing a post:
a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);
h) Can uniquely, spirally lock the three-dimensionally-adjustable three-dimensionally-alignable articulating spike system into a angled surface
(FIGS. 4E, 4F, 4G, and 4H);
i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can uniquely, spirally lock the three-dimensionally-adjustable three-dimensionally-alignable articulating spike system into a ground surface having submerged roots
(FIGS. 4E, 4F, 4G, and 4H).

16) It is still yet an even further object of the present invention to provide a three-dimensionally-adjustable three-dimensionally-alignable articulating spike system for securing a post,
having second offset spiral locking shovel.
Therefore, the three-dimensionally-adjustable three-dimensionally-alignable articulating spike system for securing a post:
a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface (FIGS. 4E, 4F, 4G, and 4H);

i) Can uniquely, spirally lock the three-dimensionally-adjustable three-dimensionally-alignable articulating spike system into a ground surface having submerged, inconsistent rocks (FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots (FIGS. 4E, 4F, 4G, and 4H).

17) It is still yet an even further object of the present invention to provide a three-dimensionally-adjustable three-dimensionally-alignable articulating spike system for securing a post, having third offset spiral locking shovel.

Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground (FIGS. 5A, 5B, 5C, 5D, 5E, and 5F);

b) Can spirally lock multi-spiral-locking-blade multi-offset-spiral-locking-shovel ground penetrating system in the ground (FIGS. 4E, 4F, 4G, 4H, 5B, 5C, 5D, and 5E);

c) Can lock the three-dimensionally-adjustable three-dimensionally-alignable articulating spike system in the ground (FIGS. 4B, 4C, 4F, 4G, and 4H);

d) Can uniquely, spirally lock the three-dimensionally-adjustable three-dimensionally-alignable articulating spike system into a sandy ground surface (FIGS. 5A, 5B, 5C, 5D, 5E, and 5F);

e) Can uniquely, spirally lock the three-dimensionally-adjustable three-dimensionally-alignable articulating spike system into a gravel surface (FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface (FIGS. 4E, 4F, 4G, 4H, 6A, 6B, and 6C);

g) Can uniquely, spirally lock the three-dimensionally-adjustable three-dimensionally-alignable articulating spike system into a uneven surface (FIGS. 4B, 4C, 4E, 4F, 4G, and 4H);

h) Can uniquely, spirally lock the three-dimensionally-adjustable three-dimensionally-alignable articulating spike system into a angled surface (FIGS. 4E, 4F, 4G, and 4H);

i) Can uniquely, spirally lock the three-dimensionally-adjustable three-dimensionally-alignable articulating spike system into a ground surface having submerged, inconsistent rocks (FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots (FIGS. 4E, 4F, 4G, and 4H).

18) It is still yet an even further object of the present invention to provide a three-dimensionally-adjustable three-dimensionally-alignable articulating spike system for securing a post, having fourth offset spiral locking shovel.

Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground (FIGS. 5A, 5B, 5C, 5D, 5E, and 5F);

b) Can spirally lock multi-spiral-locking-blade multi-offset-spiral-locking-shovel ground penetrating system in the ground (FIGS. 4E, 4F, 4G, 4H, 5B, 5C, 5D, and 5E);

c) Can lock the three-dimensionally-adjustable three-dimensionally-alignable articulating spike system in the ground (FIGS. 4B, 4C, 4F, 4G, and 4H);

d) Can uniquely, spirally lock the three-dimensionally-adjustable three-dimensionally-alignable articulating spike system into a sandy ground surface (FIGS. 5A, 5B, 5C, 5D, 5E, and 5F);

e) Can uniquely, spirally lock the three-dimensionally-adjustable three-dimensionally-alignable articulating spike system into a gravel surface (FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface (FIGS. 4E, 4F, 4G, 4H, 6A, 6B, and 6C);

g) Can uniquely, spirally lock the three-dimensionally-adjustable three-dimensionally-alignable articulating spike system into a uneven surface (FIGS. 4B, 4C, 4E, 4F, 4G, and 4H);

h) Can uniquely, spirally lock the three-dimensionally-adjustable three-dimensionally-alignable articulating spike system into a angled surface (FIGS. 4E, 4F, 4G, and 4H);

i) Can uniquely, spirally lock the three-dimensionally-adjustable three-dimensionally-alignable articulating spike system into a ground surface having submerged, inconsistent rocks (FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots (FIGS. 4E, 4F, 4G, and 4H).

Other objects and advantages of the present invention will become apparent from the consideration of the accompanying drawings and ensuing description.

BRIEF DESCRIPTION OF THE DRAWINGS

FIG. 7A to FIG. 7C illustrate front, top, and front-sectional views of how to adjust a three-dimensionally-adjustable three-dimensionally-alignable post-securing stanchion system to be in a 90-degree upright position.

FIG. 8A to FIG. 8E illustrate front and top views of a three-dimensionally-adjustable three-dimensionally-alignable post-securing stanchion system, and how it secure a post in a 90-degree upright position.

SUMMARY OF THE INVENTION

Figure 1:
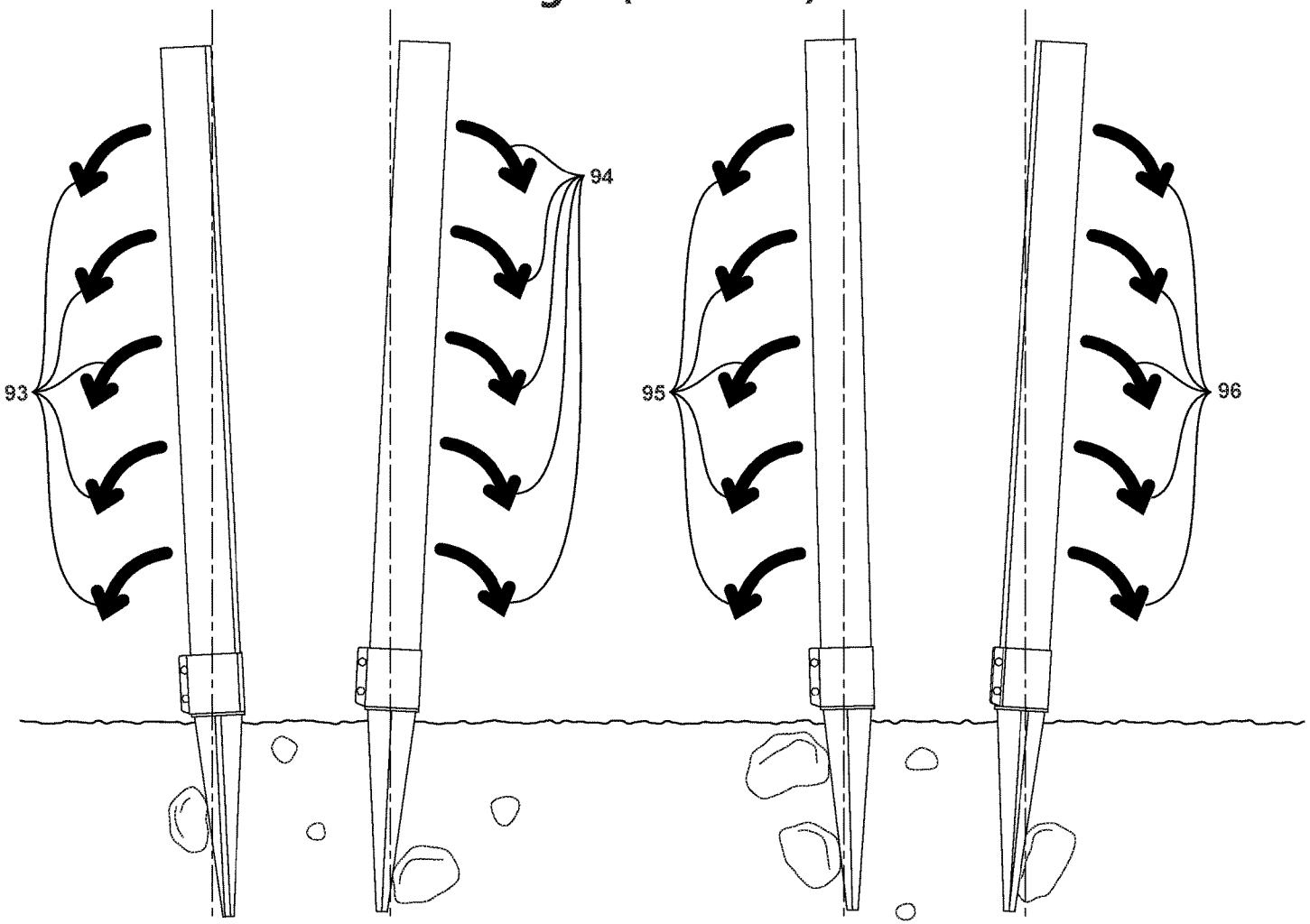
Fig. 1 (Prior Art)
FIG. 1 (Prior Art) and FIG. 2 (Prior Art) illustrate front and top views of prior art with their disadvantages of not being able to secure posts in a 90-degree upright position.

A three-dimensionally-adjustable spike for securing a post comprises: two C-shaped walls, two wrench-accessible openings formed in the two C-shaped walls, a base molded to the two C-shaped walls, two post-elevating struts welded to the base, post-clamping screws screwed into the two C-shaped walls and the post, convex bolts each having a convex bolt bottom, concave upper washers each having an upper concave surface engaging with the convex bolt bottom, concave lower washers each having a lower concave surface, convex locking nuts each having a convex nut top engaging with the lower concave surface for three-dimensionally adjusting and securing the stanchion base and the post perpendicularly to the ground, a hammer plate, plate nuts welded to the hammer plate for stationarily securing the convex locking bolts to the hammer plate, spiral blades, offset spiral shovels, and a spike welded to the spiral blades, the offset spiral shovels, and the hammer plate.

DETAILED DESCRIPTION OF THE INVENTION

Component

A three-dimensionally-adjustable three-dimensionally-alignable articulating spike system for securing a post, having:

1) Three-dimensionally-adjustable three-dimensionally-alignable post-securing stanchion system,
2) Three-dimensionally-adjustable three-dimensionally-alignable stanchion-securing bolt system,
3) Multi-spiral-locking-blade multi-offset-spiral-locking-shovel ground-penetrating system, and
4) Rust-preventing stanchion-covering system.

Referring to FIGS. 3A, 3R, 3C, 4A, 4B, 4C, 4B, 4E, 4F, 4G, and 4H, a three-dimensionally-adjustable three-dimensionally-alignable articulating spike system for securing a post comprises:

1) A three-dimensionally-adjustable three-dimensionally-alignable post-securing stanchion system 101, comprising:
2) First post-clamping C-shaped wall 102,
3) Second post-clamping C-shaped wall 103,
4) First post-perimeter-adjusting split 104,
5) Second post-perimeter-adjusting split 105,
6) First wrench-accessed opening 106,
7) Second wrench-accessed opening 107,
8) First stanchion-cover-locking wall hook 108,
9) Second stanchion-cover-locking wall hook 109,
10) A three-dimensionally-adjustable three-dimensionally-alignable stanchion base 110,
11) First post-elevating strut 111,
12) Second post-elevating strut 112,
13) Horizontal-angle-adjusting rotatable openings 113,
14) Post-clamping screw holes 114,
15) Post-clamping screws 115;
16) A three-dimensionally-adjustable three-dimensionally-alignable stanchion-securing bolt system 116, comprising:
17) Three-dimensionally-adjustable three-dimensionally-alignable convex locking bolts 117,
18) Three-dimensionally-adjustable three-dimensionally-alignable concave upper washers 118,
19) Three-dimensionally-adjustable three-dimensionally-alignable concave lower washers 119,
20) Three-dimensionally-adjustable three-dimensionally-alignable convex locking nuts 120;
21) A multi-spiral-locking-blade multi-offset-spiral-locking-shovel ground-penetrating system 121, comprising:
22) A stanchion-securing hammer plate 122,
23) Stationary hammer-plate nuts 123,
24) First spiral locking blade 124,
25) Second spiral locking blade 125,
26) Third spiral locking blade 126,
27) Fourth spiral locking blade 127,
28) First offset spiral locking shovel 128,
29) Second offset spiral locking shovel 129,
30) Third offset spiral locking shovel 130,
31) Fourth offset spiral locking shovel 131,
32) Ground-penetrating X-cross-sectional spike 132; and
33) A rust-preventing stanchion-covering system 133, comprising:

34) Rust-preventing cover 134,
35) First cover snap-lock 135,
36) Second cover snap-lock 136.

Material

Referring to FIGS. 3A, 3B, 3C, 4A, 4B, 4C, 4D, 4E, 4F, 4G, and 4H:

1) Three-dimensionally-adjustable three-dimensionally-alignable post-securing stanchion system 101 is made of the combined materials of its components.
2) First post-clamping C-shaped wall 102 is made of metallic material.
3) Second post-clamping C-shaped wall 103 is made of metallic material.
4) First post-perimeter-adjusting split 104 is made of empty space.
5) Second post-perimeter-adjusting split 105 is made of empty space.
6) First wrench-accessed opening 106 is made of empty space.
7) Second wrench-accessed opening 107 is made of empty space.
8) First stanchion-cover-locking wall hook 108 is made of metallic material.
9) Second stanchion-cover-locking wall hook 109 is made of metallic material.
10) Three-dimensionally-adjustable three-dimensionally-alignable stanchion base 110 is made of metallic material.
11) First post-elevating strut 111 is made of metallic material.
12) Second post-elevating strut 112 is made of metallic material.
13) Horizontal-angle-adjusting rotatable openings 113 each are made of empty space.
14) Post-clamping screw holes 114 each are made of empty space.
15) Post-clamping screws 115 each are made of metallic material.
16) Three-dimensionally-adjustable three-dimensionally-alignable stanchion-securing bolt system 116 is made of the combined materials of its components.
17) Three-dimensionally-adjustable three-dimensionally-alignable convex locking bolts 117 each are made of metallic material.
18) Three-dimensionally-adjustable three-dimensionally-alignable concave upper washers 118 each are made of metallic material.
19) Three-dimensionally-adjustable three-dimensionally-alignable concave lower washers 119 each are made of metallic material.
20) Three-dimensionally-adjustable three-dimensionally-alignable convex locking nuts 120 each are made of metallic material.
21) Multi-spiral-locking-blade multi-offset-spiral-locking-shovel ground-penetrating system 121 is made of the combined materials of its components.
22) A stanchion-securing hammer plate 122 is made of metallic material.
23) Stationary hammer-plate nuts 123 each are made of metallic material.
24) First spiral locking blade 124 is made of metallic material.
25) Second spiral locking blade 125 is made of metallic material.
26) Third spiral locking blade 126 is made of metallic material.
27) Fourth spiral locking blade 127 is made of metallic material.
28) First offset spiral locking shovel 128 is made of metallic material.
29) Second offset spiral locking shovel 129 is made of metallic material.
30) Third offset spiral locking shovel 130 is made of metallic material.
31) Fourth offset spiral locking shovel 131 is made of metallic material.
32) Ground-penetrating X-cross-sectional spike 132 is made of metallic material.
33) Rust-preventing stanchion-covering system 133 is made of the combined materials of its components.
34) Rust-preventing cover 134 is made of plastic material.
35) First cover snap-lock 135 is made of plastic material.
36) Second cover snap-lock 136 is made of plastic material.

Shape

Referring to FIGS. 3A, 3B, 3C, 4A, 4B, 4C, 4D, 4E, 4F, 4G, and 4H:

1) Three-dimensionally-adjustable three-dimensionally-alignable post-securing stanchion system 101 has the combined shapes of its components.
2) First post-clamping C-shaped wall 102 has a C shape.
3) Second post-clamping C-shaped wall 103 has a C shape.
4) First post-perimeter-adjusting split 104 has an elongated I shape.
5) Second post-perimeter-adjusting split 105 has an elongated I shape.
6) First wrench-accessed opening 106 has a rectangular shape.
7) Second wrench-accessed opening 107 has a rectangular shape.
8) First stanchion-cover-locking wall hook 108 has a right-angle shape.
9) Second stanchion-cover-locking wall hook 109 has a right-angle shape.
10) Three-dimensionally-adjustable three-dimensionally-alignable stanchion base 110 has a square shape.
11) First post-elevating strut 111 has a hat shape.
12) Second post-elevating strut 112 has a hat shape.
13) Horizontal-angle-adjusting rotatable openings 113 each have a kidney shape.
14) Post-clamping screw holes 114 each have a round shape.
15) Post-clamping screws 115 each have a screw shape.
16) Three-dimensionally-adjustable three-dimensionally-alignable stanchion-securing bolt system 116 has the combined shapes of its components.
17) Three-dimensionally-adjustable three-dimensionally-alignable convex locking bolts 117 each have a convex-bolt shape.
18) Three-dimensionally-adjustable three-dimensionally-alignable concave upper washers 118 each have a concave-washer shape.
19) Three-dimensionally-adjustable three-dimensionally-alignable concave lower washers 119 each have a concave-washer shape.
20) Three-dimensionally-adjustable three-dimensionally-alignable convex locking nuts 120 each have a convex-nut shape.
21) Multi-spiral-locking-blade multi-offset-spiral-locking-shovel ground-penetrating system 121 has the combined shapes of its components.
22) Stanchion-securing hammer plate 122 has a round shape.
23) Stationary hammer-plate nuts 123 each have a nut shape.
24) First spiral locking blade 124 has a triangular shape.
25) Second spiral locking blade 125 has a triangular shape.
26) Third spiral locking blade 126 has a triangular shape.

27) Fourth spiral locking blade 127 has a triangular shape.
28) First offset spiral locking shovel 128 has a triangular shape.
29) Second offset spiral locking shovel 129 has a triangular shape.
30) Third offset spiral locking shovel 130 has a triangular shape.
31) Fourth offset spiral locking shovel 131 has a triangular shape.
32) Ground-penetrating X-cross-sectional spike 132 has a tapered X-cross-sectional shape.
33) Rust-preventing stanchion-covering system 133 has the combined shapes of its components.
34) Rust-preventing cover 134 has a tapered-square-tube shape.
35) First cover snap-lock 135 has a rectangular shape.
36) Second cover snap-lock 136 has a rectangular shape.

Connection

Referring to FIGS. 3A, 3B, 3C, 4A, 4B, 4C, 4D, 4E, 4F, 4G, and 4H:

1) Three-dimensionally-adjustable three-dimensionally-alignable post-securing stanchion system 101 has the combined connections of its components.
2) First post-clamping C-shaped wall 102 is attached to three-dimensionally-adjustable three-dimensionally-alignable stanchion base 110.
3) Second post-clamping C-shaped wall 103 is attached to three-dimensionally-adjustable three-dimensionally-alignable stanchion base 110.
4) First post-perimeter-adjusting split 104 is attached to first post-clamping C-shaped wall 102 and second post-clamping C-shaped wall 103.
5) Second post-perimeter-adjusting split 105 is attached to first post-clamping C-shaped wall 102 and second post-clamping C-shaped wall 103.
6) First wrench-accessed opening 106 is attached to first post-clamping C-shaped wall 102, second post-clamping C-shaped wall 103, and three-dimensionally-adjustable three-dimensionally-alignable stanchion base 110.
7) Second wrench-accessed opening 107 is attached to first post-clamping C-shaped wall 102, second post-clamping C-shaped wall 103, and three-dimensionally-adjustable three-dimensionally-alignable stanchion base 110.
8) First stanchion-cover-locking wall hook 108 is attached to first post-clamping C-shaped wall 102 and second post-clamping C-shaped wall 103.
9) Second stanchion-cover-locking wall hook 109 is attached to first post-clamping C-shaped wall 102 and second post-clamping C-shaped wall 103.
10) Three-dimensionally-adjustable three-dimensionally-alignable stanchion base 110 is attached to first post-clamping C-shaped wall 102 and second post-clamping C-shaped wall 103.
11) First post-elevating strut 111 is attached to three-dimensionally-adjustable three-dimensionally-alignable stanchion base 110.
12) Second post-elevating strut 112 is attached to three-dimensionally-adjustable three-dimensionally-alignable stanchion base 110.
13) Horizontal-angle-adjusting rotatable openings 113 each are stamped into three-dimensionally-adjustable three-dimensionally-alignable stanchion base 110.
14) Post-clamping screw holes 114 each are stamped into first post-clamping C-shaped wall 102 and second post-clamping C-shaped wall 103.
15) Post-clamping screws 115 each are screwed into first post-clamping C-shaped wall 102 and second post-clamping C-shaped wall 103.
16) Three-dimensionally-adjustable three-dimensionally-alignable stanchion-securing bolt system 116 has the combined connections of its components.
17) Three-dimensionally-adjustable three-dimensionally-alignable convex locking bolts 117 each are connected to one three-dimensionally-adjustable three-dimensionally-alignable concave upper washer 118.
18) Three-dimensionally-adjustable three-dimensionally-alignable concave upper washers 118 each are attached to three-dimensionally-adjustable three-dimensionally-alignable stanchion base 110.
19) Three-dimensionally-adjustable three-dimensionally-alignable concave lower washers 119 each are attached to one three-dimensionally-adjustable three-dimensionally-alignable convex locking nut 120.
20) Three-dimensionally-adjustable three-dimensionally-alignable convex locking nuts 120 each are attached to one three-dimensionally-adjustable three-dimensionally-alignable convex locking bolt 117.
21) Multi-spiral-locking-blade multi-offset-spiral-locking-shovel ground-penetrating system 121 has the combined connections of its components.
22) Stanchion-securing hammer plate 122 is attached to three-dimensionally-adjustable three-dimensionally-alignable convex locking bolts 117.
23) Stationary hammer-plate nuts 123 each are welded to stanchion-securing hammer plate 122.
24) First spiral locking blade 124 is molded to ground-penetrating X-cross-sectional spike 132.
25) Second spiral locking blade 125 is molded to ground-penetrating X-cross-sectional spike 132.
26) Third spiral locking blade 126 is molded to ground-penetrating X-cross-sectional spike 132.
27) Fourth spiral locking blade 127 is molded to ground-penetrating X-cross-sectional spike 132.
28) First offset spiral locking shovel 128 is molded to ground-penetrating X-cross-sectional spike 132.
29) Second offset spiral locking shovel 129 is molded to ground-penetrating X-cross-sectional spike 132.
30) Third offset spiral locking shovel 130 is molded to ground-penetrating X-cross-sectional spike 132.
31) Fourth offset spiral locking shovel 131 is molded to ground-penetrating X-cross-sectional spike 132.
32) Ground-penetrating cross spike 132 is welded to stanchion-securing hammer plate 122.
33) Rust-preventing stanchion-covering system 133 has the combined connections of its components.
34) Rust-preventing cover 134 is attached to first post-clamping C-shaped wall 102 and second post-clamping C-shaped wall 103.
35) First cover snap-lock 135 is snap-hooked on first post-clamping C-shaped wall 102 and second post-clamping C-shaped wall 103.
36) Second cover snap-lock 136 is snap-hooked on first post-clamping C-shaped wall 102 and second post-clamping C-shaped wall 103.

Function

Referring to FIGS. 4A, 4B, 4C, 4D, 4E, 4F, 4G, and 4H:

1) Three-dimensionally-adjustable three-dimensionally-alignable post-securing stanchion system 101 is for performing the combined functions of its components.
2) First post-clamping C-shaped wall 102 is for clamping onto a post.

3) Second post-clamping C-shaped wall 103 is for clamping onto a post.

4) First post-perimeter-adjusting split 104 is for providing flexibility between first post-clamping C-shaped wall 102 and second post-clamping C-shaped wall 103.

5) Second post-perimeter-adjusting split 105 is for providing flexibility between first post-clamping C-shaped wall 102 and second post-clamping C-shaped wall 103.

6) First wrench-accessed opening 106 is for providing an opening for wrench access.

7) Second wrench-accessed opening 107 is for providing an opening for wrench access.

8) First stanchion-cover-locking wall hook 108 is for hooking rust-preventing cover 134 onto.

9) Second stanchion-cover-locking wall hook 109 is for hooking rust-preventing cover 134 onto.

10) Three-dimensionally-adjustable three-dimensionally-alignable stanchion base 110 is for three-dimensionally adjusting, three-dimensionally aligning, and horizontally rotating three-dimensionally-adjustable three-dimensionally-alignable post-securing stanchion system 101.

11) First post-elevating strut 111 is for:

Elevating and supporting a post bottom, to create an empty space between the post bottom and stanchion base 110 and stanchion-securing bolt system 116, to allow stanchion-securing bolt system 116 to move freely;

Allowing rain water to evaporate away from the post bottom;

Keeping the post bottom dry;

Preventing the post bottom from getting rotten;

Allowing rain water to evaporate away from the stanchion base;

Keeping the stanchion base dry;

Preventing the stanchion base from getting rusted;

Allowing rain water to evaporate away from the stanchion-securing bolt system;

Keeping the stanchion-securing bolt system dry; and

Preventing the stanchion-securing bolt system from getting rusted.

12) Second post-elevating strut 112 is for:

Elevating and supporting a post bottom, to create an empty space between the post bottom and stanchion base 110 and stanchion-securing bolt system 116, to allow stanchion-securing bolt system 116 to move freely;

Allowing rain water to evaporate away from the post bottom;

Keeping the post bottom dry;

Preventing the post bottom from getting rotten;

Allowing rain water to evaporate away from the stanchion base;

Keeping the stanchion base dry;

Preventing the stanchion base from getting rusted;

Allowing rain water to evaporate away from the stanchion-securing bolt system;

Keeping the stanchion-securing bolt system dry; and

Preventing the stanchion-securing bolt system from getting rusted.

13) Horizontal-angle-adjusting rotatable openings 113 each are for:

Allowing stanchion base 110 to be horizontally rotatable and adjustable;

Draining rain water away from the post bottom;

Keeping the post bottom dry;

Preventing the post bottom from getting rotten;

Draining rain water away from stanchion base 110;

Keeping stanchion base 110 dry;

Preventing stanchion base 110 from getting rusted;

Draining rain water away from stanchion-securing bolt system 116;

Keeping stanchion-securing bolt system 116 dry; and

Preventing stanchion-securing bolt system 116 from getting rusted.

14) Post-clamping screw holes 114 each are for one post-clamping screw 115 to be screwed therethrough.

15) Post-clamping screws 115 each are for being screwed through one post-clamping screw hole 114 into a post.

16) Three-dimensionally-adjustable three-dimensionally-alignable stanchion-securing bolt system 116 is for performing the combined functions of its components.

17) Three-dimensionally-adjustable three-dimensionally-alignable convex locking bolts 117 each are for:

Being three-dimensionally adjustable and alignable within one three-dimensionally-adjustable three-dimensionally-alignable concave upper washer 118;

Connecting and locking one three-dimensionally-adjustable three-dimensionally-alignable concave upper washer 118, one three-dimensionally-adjustable three-dimensionally-alignable concave lower washer 119, and one three-dimensionally-adjustable three-dimensionally-alignable convex locking nuts 120, securely in a fixed position; and Connecting and locking three-dimensionally-adjustable three-dimensionally-alignable stanchion base 110 to stanchion-securing hammer plate 122, securely in a fixed position.

18) Three-dimensionally-adjustable three-dimensionally-alignable concave upper washers 118 each are for providing a concave surface for three-dimensionally adjusting one three-dimensionally-adjustable three-dimensionally-alignable convex locking bolt 117.

19) Three-dimensionally-adjustable three-dimensionally-alignable concave lower washers 119 each are for providing a concave surface for three-dimensionally adjusting one three-dimensionally-adjustable three-dimensionally-alignable convex locking nut 120.

20) Three-dimensionally-adjustable three-dimensionally-alignable convex locking nuts 120 each are for:

Being three-dimensionally adjustable and alignable within one three-dimensionally-adjustable three-dimensionally-alignable concave lower washer 119;

Connecting and locking one three-dimensionally-adjustable three-dimensionally-alignable convex locking bolt 117, one three-dimensionally-adjustable three-dimensionally-alignable concave upper washer 118, and one three-dimensionally-adjustable three-dimensionally-alignable concave lower washer 119, securely in a fixed position; and Connecting and locking three-dimensionally-adjustable three-dimensionally-alignable stanchion base 110 to stanchion-securing hammer plate 122, securely in a fixed position.

21) Multi-spiral-locking-blade multi-offset-spiral-locking-shovel ground-penetrating system 121 is for performing the combined functions of its components.

22) Stanchion-securing hammer plate 122 is for securing three-dimensionally-adjustable three-dimensionally-alignable post-securing stanchion system 101 to multi-spiral-locking-blade multi-offset-spiral-locking-shovel ground-penetrating system 121.

23) Stationary hammer-plate nuts 123 each are for locking one three-dimensionally-adjustable three-dimensionally-alignable convex locking bolt 117.

24) First spiral locking blade 124 is for:
Spirally piercing into the ground to create a piercing track; and
Spirally locking multi-spiral-locking-blade multi-offset-spiral-locking-shovel ground-penetrating system 121 in the ground.

25) Second spiral locking blade 125 is for:
Spirally piercing into the ground to create a piercing track; and
Spirally locking multi-spiral-locking-blade multi-offset-spiral-locking-shovel ground-penetrating system 121 in the ground.

26) Third spiral locking blade 126 is for:
Spirally piercing into the ground to create a piercing track; and
Spirally locking multi-spiral-locking-blade multi-offset-spiral-locking-shovel ground-penetrating system 121 in the ground.

27) Fourth spiral locking blade 127 is for:
Spirally piercing into the ground to create a piercing track; and
Spirally locking multi-spiral-locking-blade multi-offset-spiral-locking-shovel ground-penetrating system 121 in the ground.

28) First offset spiral locking shovel 128 is for:
Spirally shoveling soil into the piercing track made by first spiral locking blade 124, to fill the piercing track up with soil to lock first spiral locking blade 124 in the ground; and
Spirally locking multi-spiral-locking-blade multi-offset-spiral-locking-shovel ground-penetrating system 121 in the ground.

29) Second offset spiral locking shovel 129 is for:
Spirally shoveling soil into the piercing track made by second spiral locking blade 125, to fill the piercing track up with soil to lock second spiral locking blade 125 in the ground; and
Spirally locking multi-spiral-locking-blade multi-offset-spiral-locking-shovel ground-penetrating system 121 in the ground.

30) Third offset spiral locking shovel 130 is for:
Spirally shoveling soil into the piercing track made by third spiral locking blade 126, to fill the piercing track up with soil to lock third spiral locking blade 126 in the ground; and
Spirally locking multi-spiral-locking-blade multi-offset-spiral-locking-shovel ground-penetrating system 121 in the ground.

31) Fourth offset spiral locking shovel 131 is for:
Spirally shoveling soil into the piercing track made by fourth spiral locking blade 127, to fill the piercing track up with soil to lock fourth spiral locking blade 127 in the ground; and
Spirally locking multi-spiral-locking-blade multi-offset-spiral-locking-shovel ground-penetrating system 121 in the ground.

32) Ground-penetrating X-cross-sectional spike 132 is for penetrating into the ground.

33) Rust-preventing stanchion-covering system 133 is for performing the combined functions of its components.

34) Rust-preventing cover 134 is for protecting three-dimensionally-adjustable three-dimensionally-alignable post-securing stanchion system 101 from weather elements to prevent it from rusting.

35) First cover snap-lock 135 is for snap-locking rust-preventing cover 134 on first stanchion-cover-locking wall hook 108.

36) Second cover snap-lock 136 is for snap-locking rust-preventing cover 134 on second stanchion-cover-locking wall hook 109.

Operation

Figure 5A:
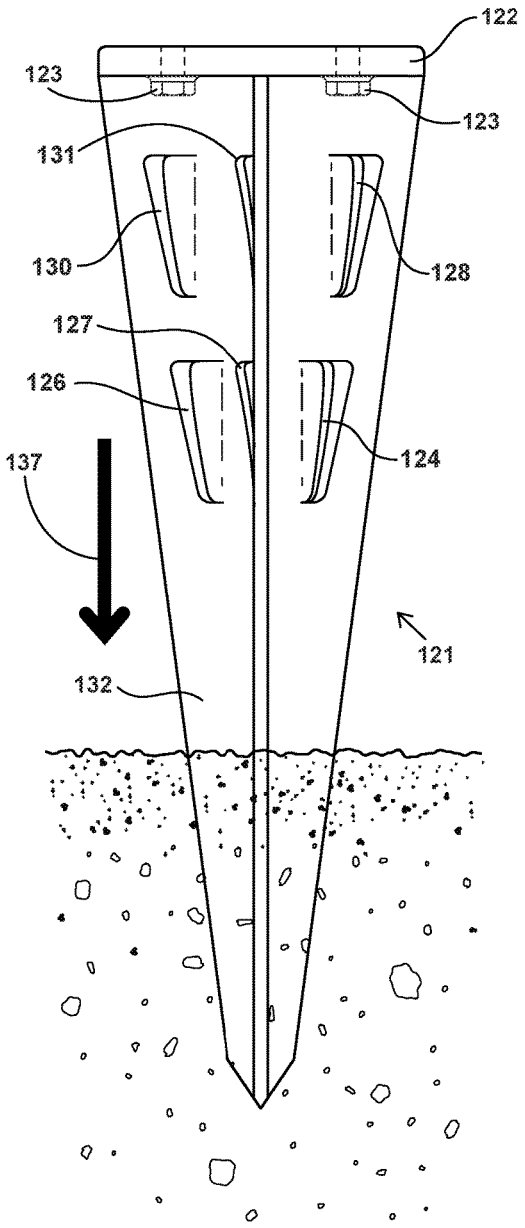
FIG. 5A to FIG. 5C illustrate front, top, and bottom views of a multi-spiral-locking-blade multi-offset-spiral-locking-shovel ground-penetrating system, and how it penetrates the ground.
Figure 5B:
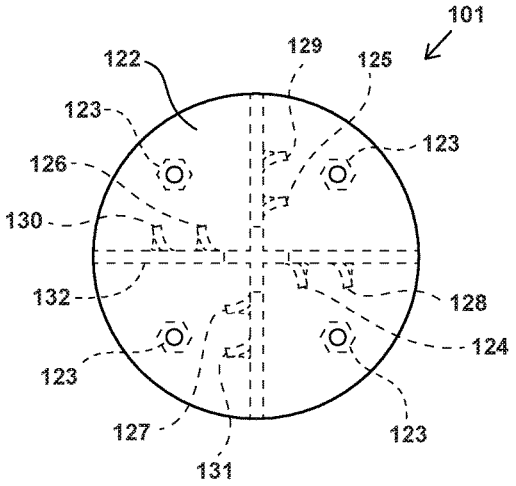
Figure 5C:
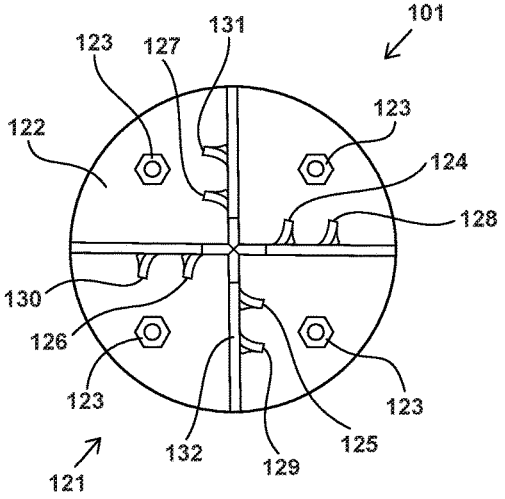
Figure 5D:
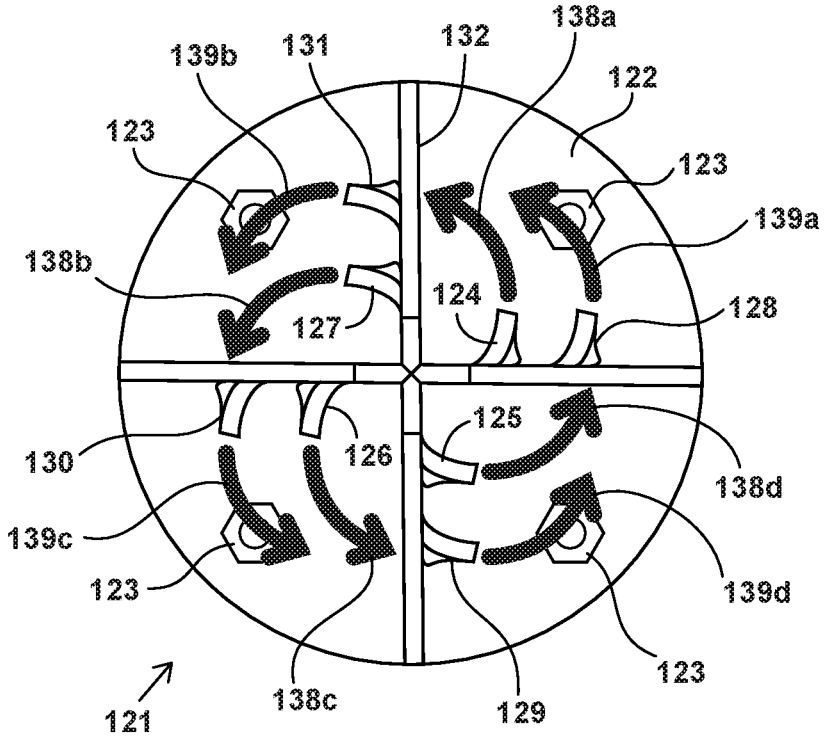
FIG. 5D to FIG. 5F illustrate bottom and front views of a multi-spiral-locking-blade multi-offset-spiral-locking-shovel ground-penetrating system, and how its offset spiral locking shovels fill up the tracks made by its spiral locking blades to secure them in the ground.
Figure 5E:
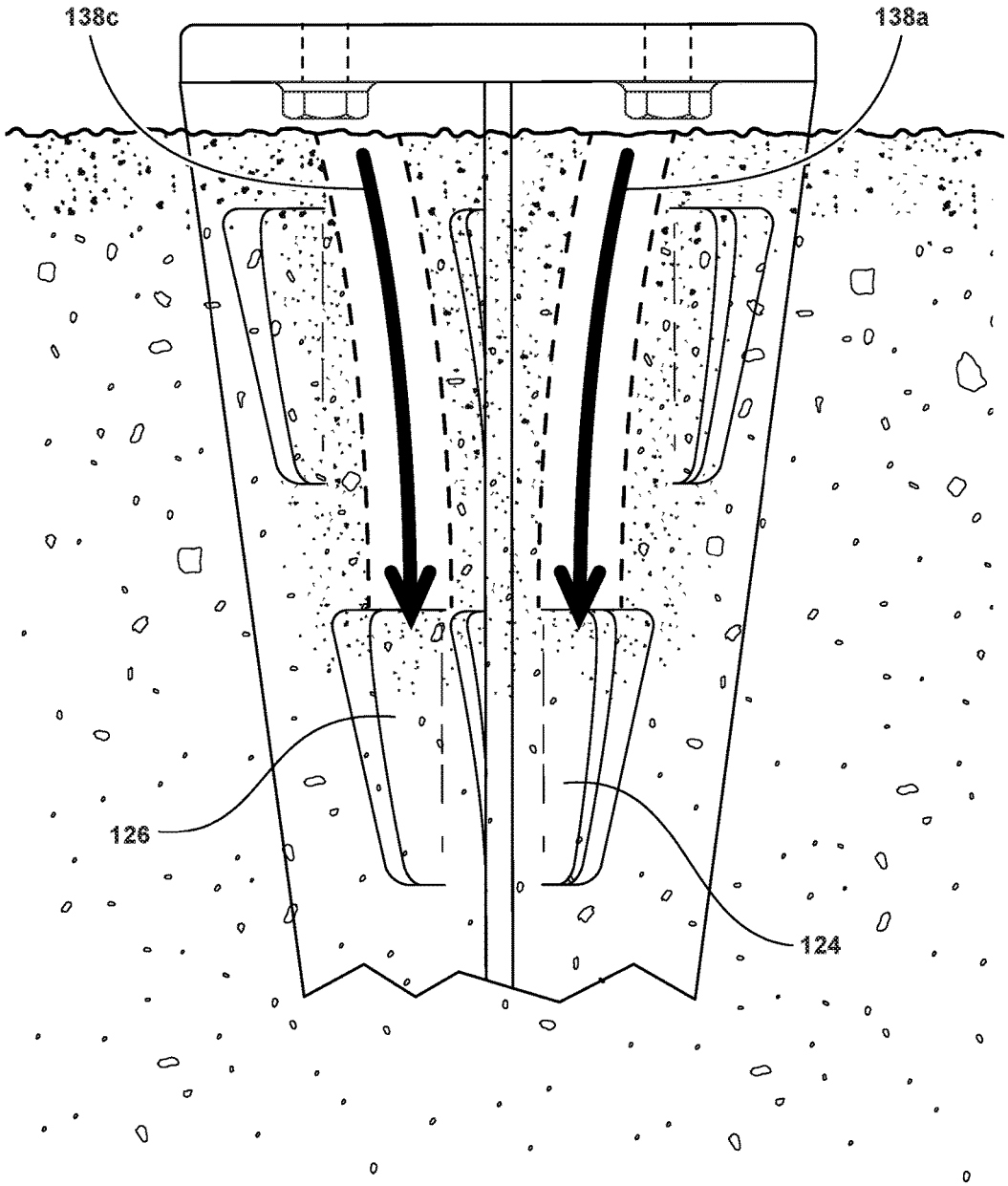
Figure 5F:
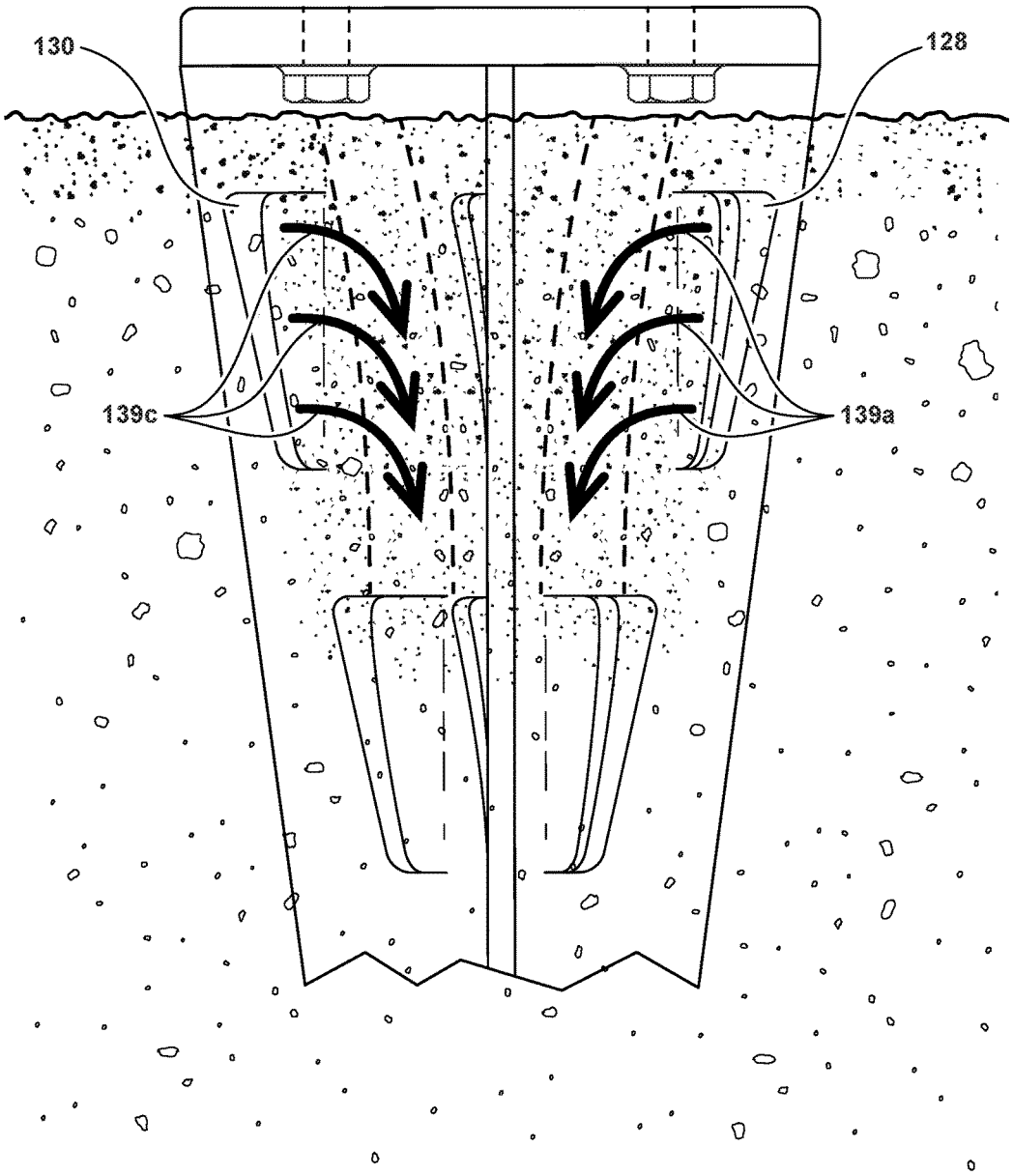
Figure 6A:
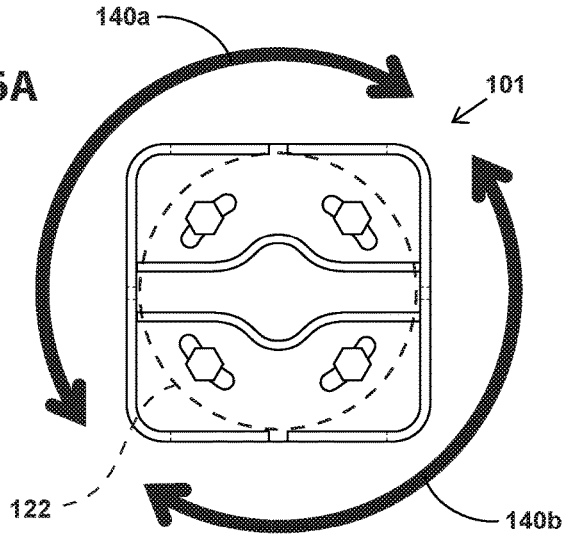
FIG. 6A to FIG. 6C illustrate top views of first and second post-clamping C-shaped walls, and how they are rotated to be adjusted horizontally.
Figure 6B:
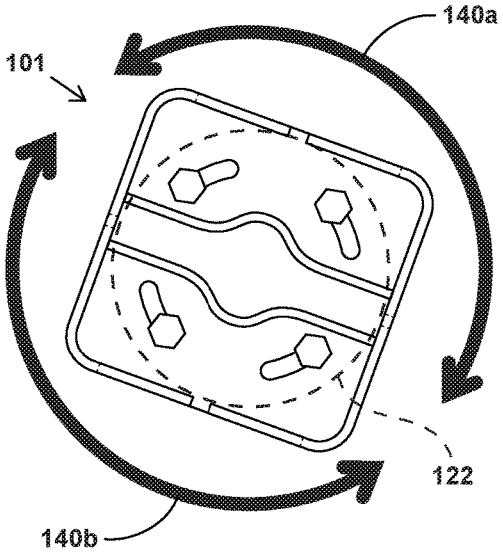
Figure 6C:
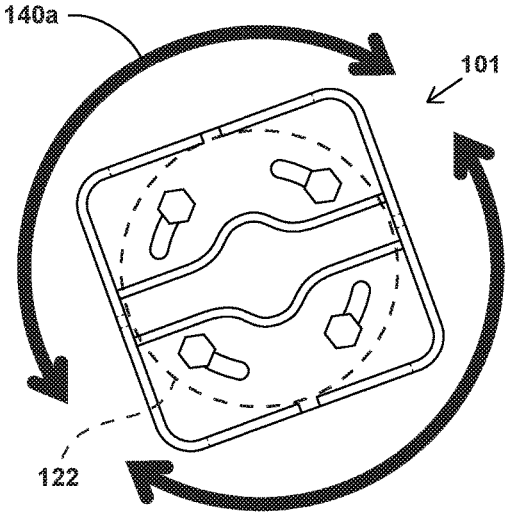

Referring to FIGS. 5A, 5B, 5C, 5D, 5E, 5F, 6A, 6B, 6C, 7A, 7B, 7C, 8A, 8B, 8C, 8D, and 8E, the operation of the three-dimensionally-adjustable three-dimensionally-alignable articulating spike system for securing a post comprises:

1) Hammering multi-spiral-locking-blade multi-offset-spiral-locking-shovel ground-penetrating system 121 into the ground,
in the direction of arrow 137
(FIG. 5A)
such that first, second, third, and fourth spiral locking blades 124, 125, 126, and 127:
Spirally pierce into the ground to create piercing tracks, in the direction of arrows 138*a*, 138*b*, 138*c*, and 138*d*
(FIGS. 5D and 5E), and
Spirally lock multi-spiral-locking-blade multi-offset-spiral-locking-shovel ground-penetrating system 121 in the ground
(FIGS. 5D and 5E), and
such that first, second, third, and fourth offset spiral locking shovels 128, 129, 130, and 131:
Spirally shovel the soil into the piercing tracks made by first, second, third, and fourth spiral locking blades 124, 125, 126, and 127 to fill the piercing tracks up with soil to lock first, second, third, and fourth spiral locking blades 124, 125, 126, and 127 in the ground, respectively, in the direction of arrows 139*a*, 139*b*, 139*c*, and 139*d*
(FIGS. 5D and 5F), and
Spirally lock multi-spiral-locking-blade multi-offset-spiral-locking-shovel ground-penetrating system 121 in the ground
(FIGS. 5D and 5F);

2) Rotating three-dimensionally-adjustable three-dimensionally-alignable stanchion base 110 to a desired position,
in the direction of arrows 140*a* and 140*b*
(FIGS. 6A, 6B, and 6C);

3) Inserting three-dimensionally-adjustable three-dimensionally-alignable convex locking bolts 117 though three-dimensionally-adjustable three-dimensionally-alignable concave upper washers 118, horizontal-angle-adjusting rotatable openings 113, three-dimensionally-adjustable three-dimensionally-alignable concave lower washers 119, respectively
(FIGS. 7A, 7B, and 7C);

4) Screwing three-dimensionally-adjustable three-dimensionally-alignable convex locking bolts 117 though three-dimensionally-adjustable three-dimensionally-alignable convex locking nuts 120 and stationary hammer-plate nuts 123, respectively,
(FIGS. 7A, 7B, and 7C);

5) Adjusting three-dimensionally-adjustable three-dimensionally-alignable post-securing stanchion system 101 and three-dimensionally-adjustable three-dimensionally-alignable stanchion-securing bolt system 116,
in the direction of arrows 140*c*, 140*d*, 140*e*, and 140*f*
(FIGS. 4B, 4C, 7A, 7B, and 7C)
such that three-dimensionally-adjustable three-dimensionally-alignable post-securing stanchion system 101 is in an upright position (perpendicular to the ground, regardless of the ground-penetrating angle of multi-spiral-locking-blade multi-offset-spiral-locking-shovel ground-penetrating system 121);

6) Tightening three-dimensionally-adjustable three-dimensionally-alignable convex locking bolts 117 and three-dimensionally-adjustable three-dimensionally-alignable convex locking nuts 120,
   in the direction of arrow 141 by using ratchet 142 or wrench 143, and
   in the direction of arrow 144 by using wrench 145
   (FIGS. 7A, 7B, and 7C)
   such that three-dimensionally-adjustable three-dimensionally-alignable post-securing stanchion system 101 is locked in its upright position
   (perpendicular to the ground, regardless of the ground-penetrating angle of multi-spiral-locking-blade multi-offset-spiral-locking-shovel ground-penetrating system 121);
7) Inserting a post 146*a* into three-dimensionally-adjustable three-dimensionally-alignable post-securing stanchion system 101 until post 146*a* rests on first and second post-elevating struts 111 and 112
   (FIG. 7C)
   such that first and second post-elevating struts 111 and 112 create an empty space 146*b* between the bottom of post 146*a* and stanchion base 110 and stanchion-securing bolt system 116. Empty space 146*b:*
   Allows stanchion-securing bolt system 116 to move freely,
   Allows rain water to evaporate away from the bottom of post 146*a,*
   Keeps the bottom of post 146*a* dry,
   Prevents the bottom of post 146*a* from getting rotten,
   Allows rain water to evaporate away from stanchion base 110,
   Keeps stanchion base 110 dry,
   Prevents stanchion base 110 from getting rusted,
   Allows rain water to evaporate away from stanchion-securing bolt system 116,
   Keeps stanchion-securing bolt system 116 dry, and
   Prevents stanchion-securing bolt system 116 from getting rusted
   (FIG. 7C); and
8) Screwing post-clamping screws 115 though post-clamping screw holes 114 into post 146*a*, respectively, to secure post 146*a* an upright position
   (perpendicular to the ground, regardless of the ground-penetrating angle of multi-spiral-locking-blade multi-offset-spiral-locking-shovel ground-penetrating system 121)
   (FIGS. 8A, 8B, 8C, 8D, and 8E).

Variation

FIGS. 9A, 9B, 9C, and 9D illustrate an equivalent 147 of three-dimensionally-adjustable three-dimensionally-alignable post-securing stanchion system 101. Equivalent 147 comprises two separate halves and screws.

Figure 10C:
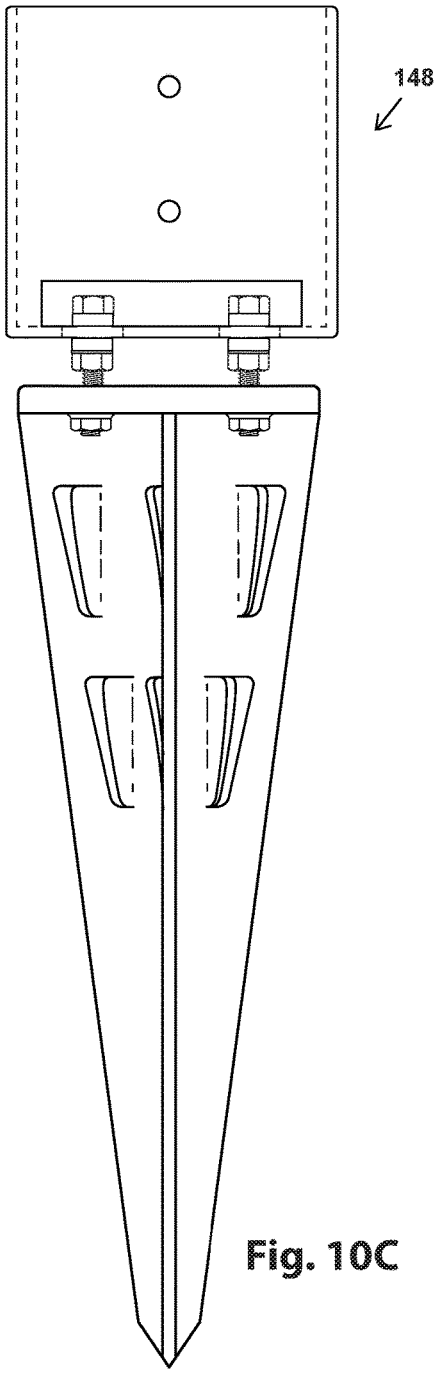
FIG. 10A to FIG. 10C illustrate top, side, and front views of another equivalent of a three-dimensionally-adjustable three-dimensionally-alignable post-securing stanchion system.
Figure 10A:
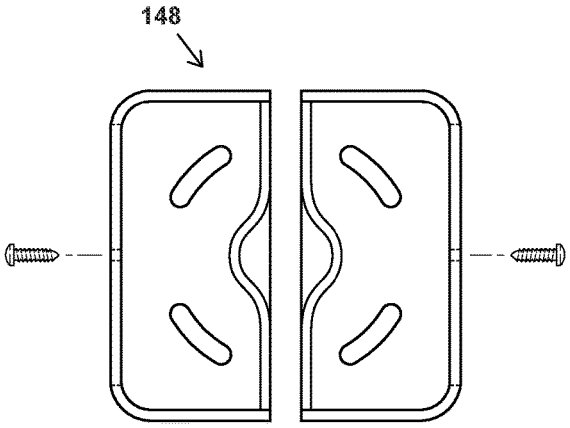
Figure 10B:
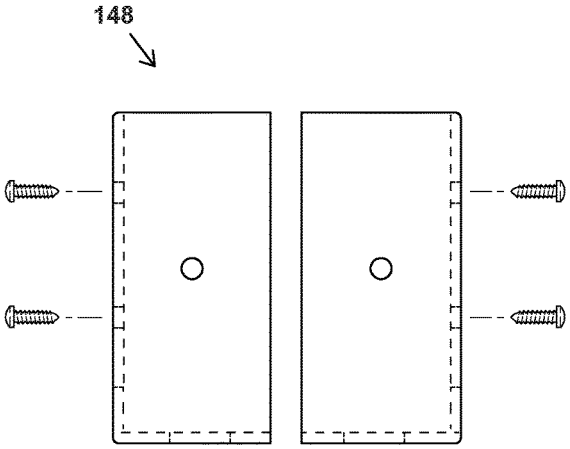

FIGS. 10A, 10B, and 10C illustrate another equivalent 148 of three-dimensionally-adjustable three-dimensionally-alignable post-securing stanchion system 101. Equivalent 148 comprises two separate halves and screws.

Figure 11A:
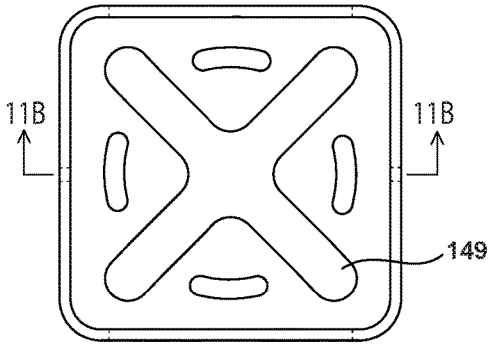
FIG. 11A to FIG. 11B illustrate top and front-sectional views of post-elevating-strut equivalent.
Figure 11B:
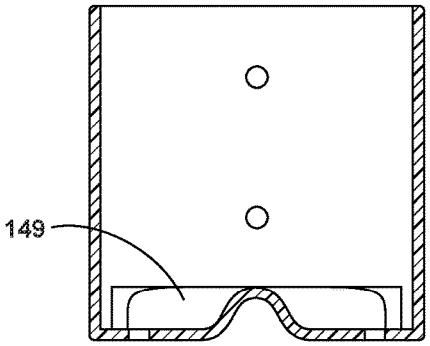

FIGS. 11A and 11B illustrate an equivalent 149 of first and second post-elevating struts 111 and 112. Equivalent 149 comprises an elevated X-shaped strut.

Figure 12A:
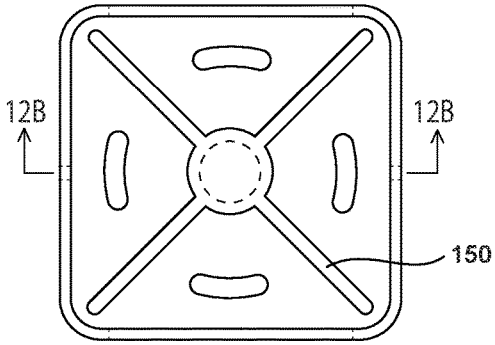
FIG. 12A to FIG. 12B illustrate top and front-sectional views of post-elevating-strut equivalent.
Figure 12B:
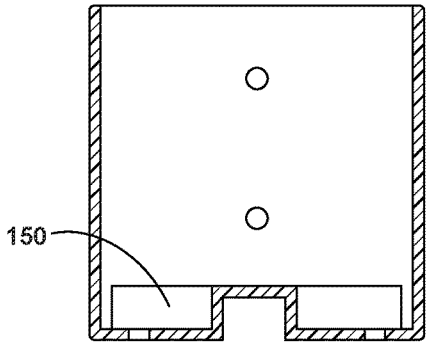

FIGS. 12A and 12B illustrate an equivalent 150 of first and second post-elevating struts 111 and 112. Equivalent 150 comprises an elevated propeller-shaped strut.

Figure 13A:
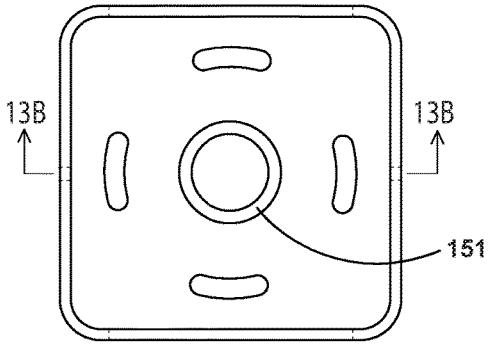
FIG. 13A to FIG. 13B illustrate top and front-sectional views of post-elevating-strut equivalent.
Figure 13B:
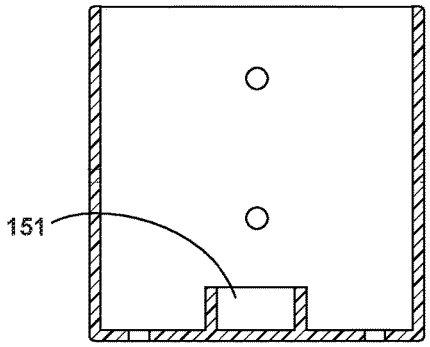

FIGS. 13A and 13B illustrate an equivalent 151 of first and second post-elevating struts 111 and 112. Equivalent 151 comprises an elevated ring-shaped strut.

Figure 14A:
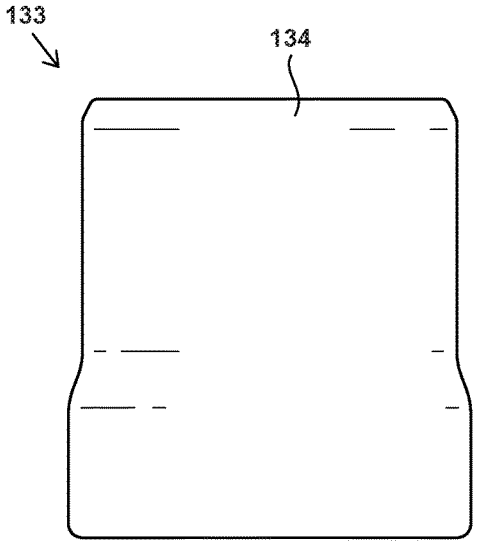
FIG. 14A to FIG. 14E illustrate front, top, front-sectional, and bottom views of a rust-preventing stanchion-covering system.
Figure 14C:
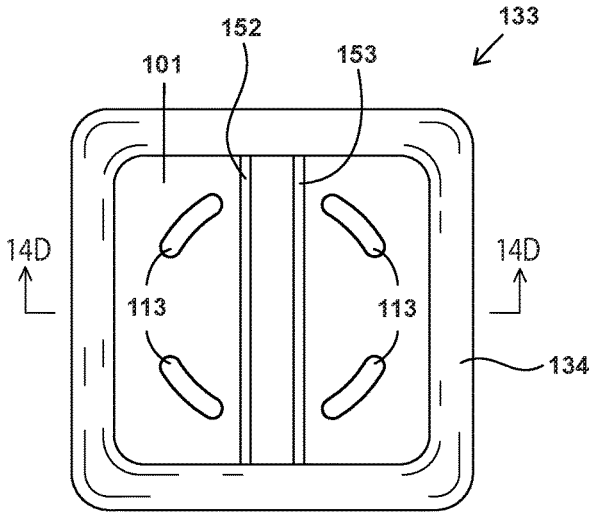
Figure 14B:
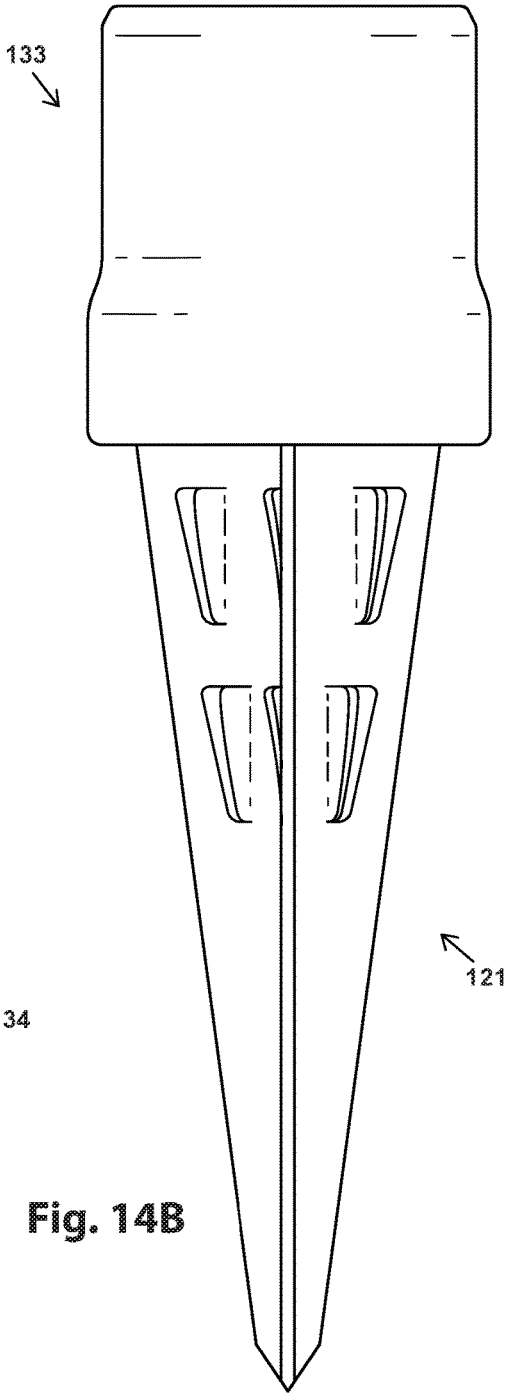

FIGS. 14A and 14B illustrate how rust-preventing cover 134 covers three-dimensionally-adjustable three-dimensionally-alignable post-securing stanchion system 101.

Figure 14D:
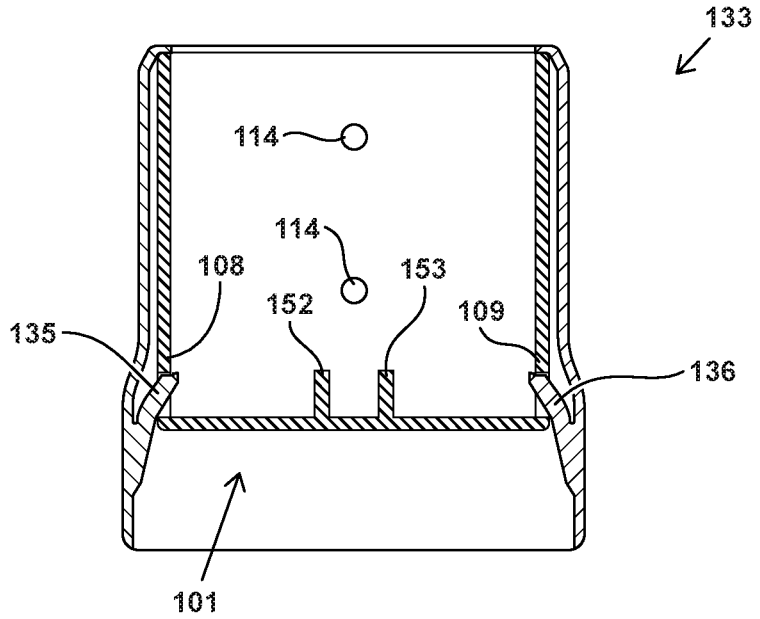
Figure 14E:
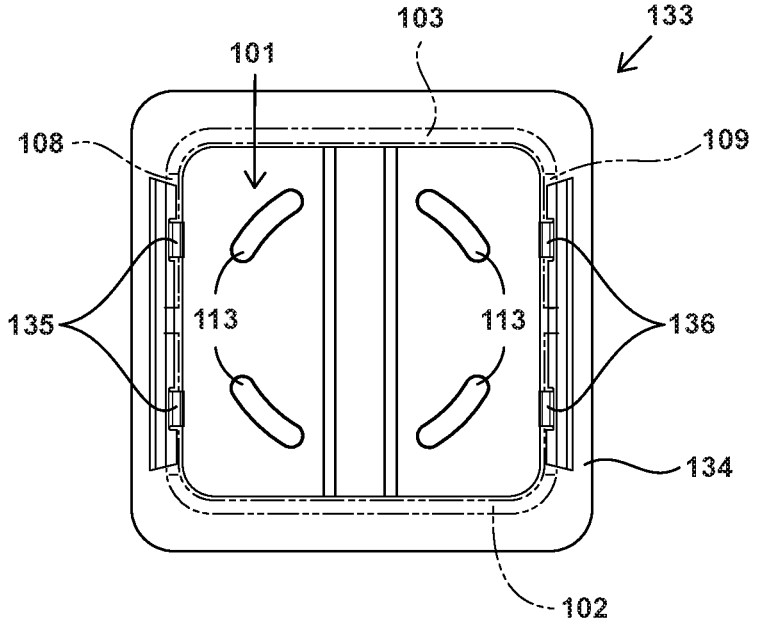

FIGS. 14C, 14D, and 14E illustrate two equivalents 152 and 153 of first and second post-elevating struts 111 and 112. Equivalents 152 and 153 comprise two elevated parallel I-shaped struts.

Major Advantages of the Invention

The present invention substantially departs from the conventional concepts and designs of the prior art. In doing so, the present invention provides a three-dimensionally-adjustable three-dimensionally-alignable articulating spike system for securing a post (having: a) Three-dimensionally-adjustable three-dimensionally-alignable post-securing stanchion system, b) Three-dimensionally-adjustable three-dimensionally-alignable stanchion-securing bolt system, c) Multi-spiral-locking-blade multi-offset-spiral-locking-shovel ground-penetrating system, and d) Rust-preventing stanchion-covering system), having many unique and significant features, functions, and advantages, which overcome all the disadvantages of the prior art, as follows:

1) It is an object of the present invention to provide a three-dimensionally-adjustable three-dimensionally-alignable articulating spike system for securing a post, having a stanchion-securing bolt system, which has:
   Convex locking bolts
   Concave upper washers
   Concave lower washers
   Convex locking nuts.
   Therefore, the three-dimensionally-adjustable three-dimensionally-alignable articulating spike system for securing a post:
   a) Can uniquely and three-dimensionally be adjustable and lockable,
      to secure the stanchion base perpendicularly to the ground
      (FIGS. 4E, 4F, 4G, and 4H);
   b) Can uniquely and three-dimensionally be adjustable and lockable,
      to prevent posts and fences from:
      Leaning,
      Warping, and
      Twisting
      (FIGS. 1 Prior Art, 2 Prior Art, 8B, 8D, and 8E);
   c) Can provide a four-point base structure for the above girth of a fence post, flag pole, mail box or sign post
      (FIGS. 7A, 7B, 7C, 8A, 8B, 8C, 8D, and 8E);
   d) Can provide four locked stanchion-securing bolts, adding substantial resistance
      to above, supported fence post, flag pole, mail box, or sign post's swaying and movement
      (FIGS. 4G, 4H, 7B, 7C, 8A, 8B, 8C, 8D, and 8E);
   e) Can provide four locked stanchion bolts, adding longevity in
      preventing potential loosening
      (FIGS. 7A, 7B, 7C, 8A, 8B, 8D, and 8E); and
   f) Can provide four locked stanchion bolts, adding longevity in preventing potential failure
      (FIGS. 7A, 7B, 7C, 8A, 8B, 8C, 8D, and 8E).

Figure 8A:
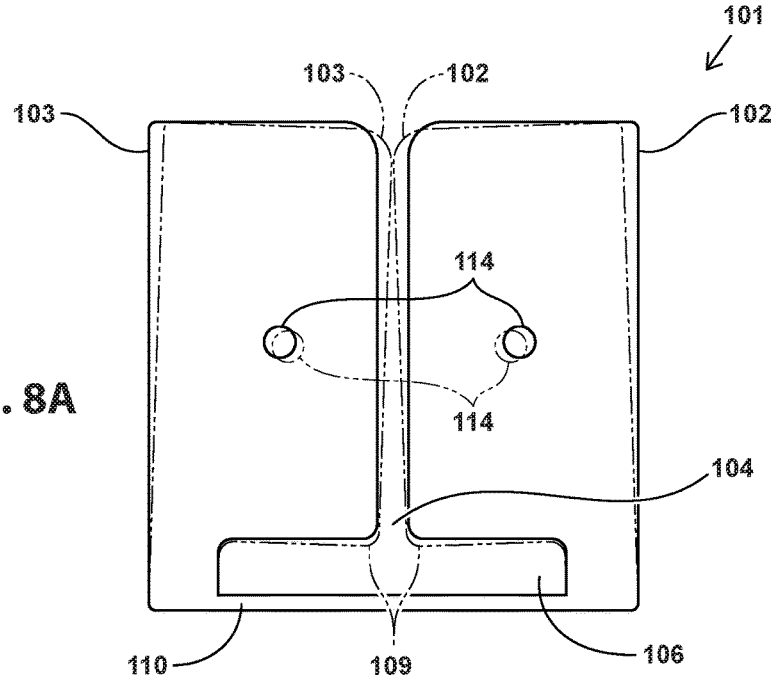
Figure 8B:
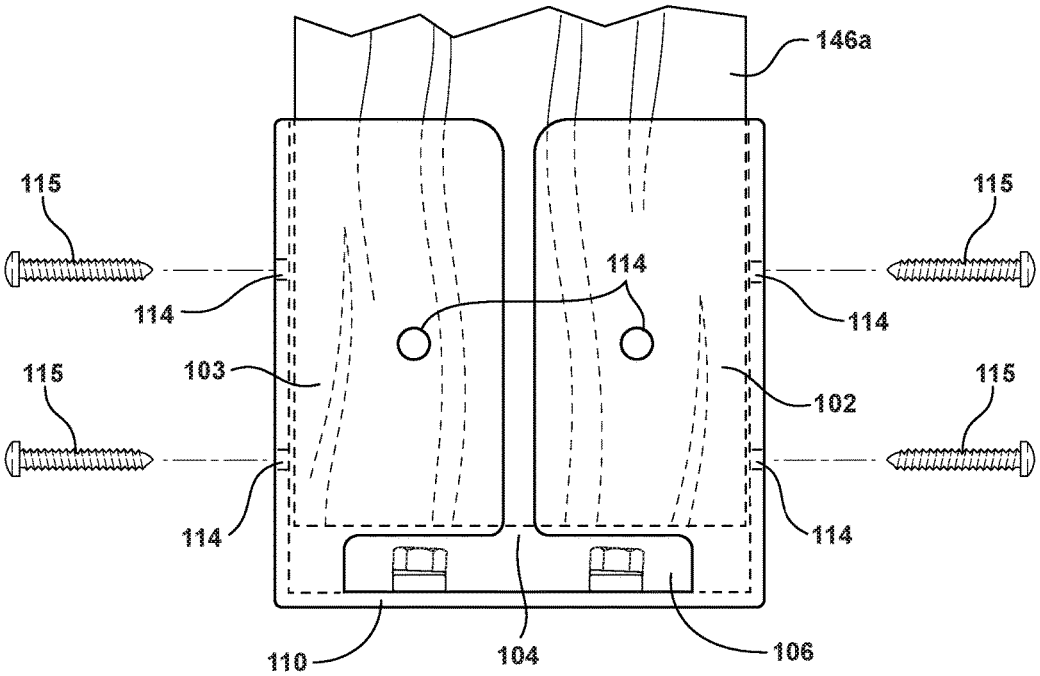
Figure 8E:
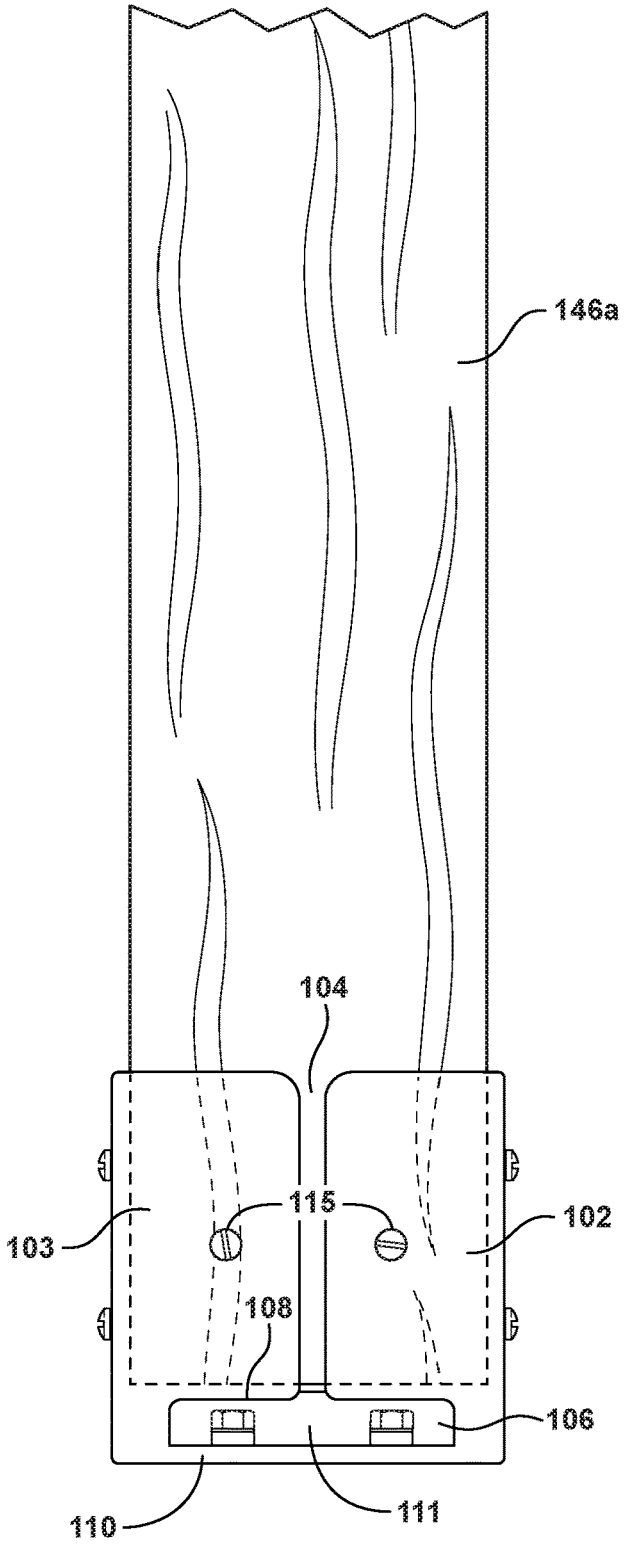
Figure 9A:
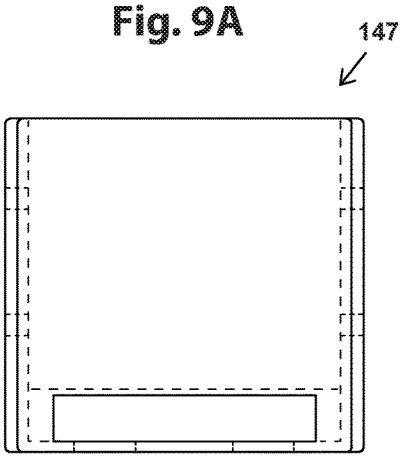
FIG. 9A to FIG. 9D illustrate front, side, and top views of an equivalent of a three-dimensionally-adjustable three-dimensionally-alignable post-securing stanchion system.
Figure 9B:
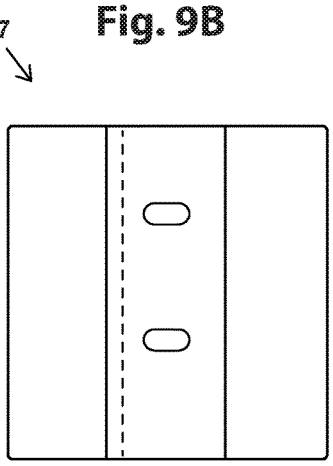
Figure 9C:
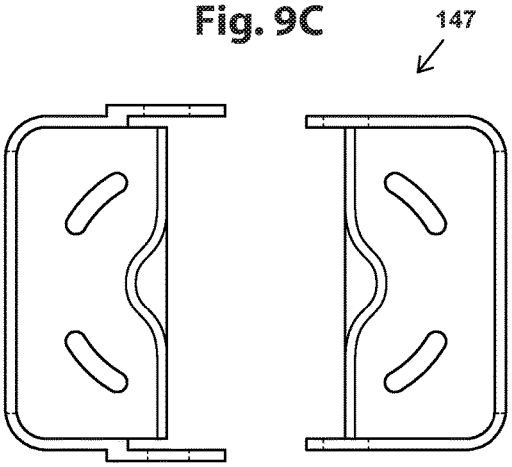
Figure 9D:
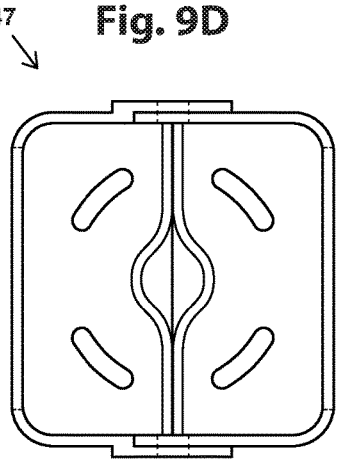

2) It is another object of the present invention to provide a three-dimensionally-adjustable three-dimensionally-alignable articulating spike system for securing a post, having a post-securing stanchion system.
   Therefore, the three-dimensionally-adjustable three-dimensionally-alignable articulating spike system for securing a post:
   a) Can be three-dimensionally adjustable and lockable (FIGS. 3A, 3B, 4A, 4B, 4C, 4G, 7A, 7B, and 7C);
   b) Can uniquely, secure a post perpendicularly to the ground (FIGS. 4E, 4F, 4G, and 4H); and
   c) Can uniquely, secure a vertical post for uses such as a fence post, flagpole, mailbox, road sign, real estate sign, etc. (FIGS. 4E, 4F, and 4H).
3) It is a further object of the present invention to provide a three-dimensionally-adjustable three-dimensionally-alignable articulating spike system for securing a post, having a post-securing stanchion system.
   Therefore, the three-dimensionally-adjustable three-dimensionally-alignable articulating spike system for securing a post:
   a) Can be three-dimensionally alignable and lockable (FIGS. 3A, 3B, 4A, 4B, 4C, 4G, 7A, 7B, and 7C);
   b) Can uniquely, secure a post in line with other posts (FIGS. 4E, 4F, 4G, and 4H);
   c) Can three-dimensionally align multiple posts within a fence-line, coursing up a hill (FIGS. 1 Prior Art, 2 Prior Art, 4E, 4F, 4G, and 4H); and
   d) Can three-dimensionally align multiple posts within a fence-line, coursing up a stair-stepped incline (FIGS. 4E, 4F, 4G, and 4H).
4) It is yet another object of the present invention to provide a three-dimensionally-adjustable three-dimensionally-alignable articulating spike system for securing a post, having a post-securing stanchion system, which has:
   An opening at its top
   Two openings in its two post-clamping C-shaped walls.
   Therefore, the three-dimensionally-adjustable three-dimensionally-alignable articulating spike system for securing a post:
   a) Can uniquely and conveniently, access and adjust the stanchion-securing bolt system:
      Through the opening at its top, and
      Through the two openings in its two post-clamping C-shaped walls
      (FIGS. 7A, 7B, 7C, 8A, and 8B);
   b) Can provide simple and convenient access to adjustment in subsequent years of use, as ground conditions change
      to produce post misalignment
      (FIGS. 2 Prior Art, 4E, 4F, 4G, and 4H);
   c) Can provide an adjustable opening and clamping capability
      to expandably accommodate multiple dimensions of posts
      (FIGS. 8A, and 8B);
   d) Can provide a pleasing aesthetic with a smooth, cubical, architectural, outer structure, having no protruding hardware or bolts
      (FIGS. 2 Prior Art, 4E, 4F, 4G, and 4H); and
   e) Can provide a pleasing aesthetic by having a three-dimensionally-adjustable three-dimensionally-alignable stanchion-securing bolt system hidden inward, and below two post-clamping C-shaped walls
      (FIGS. 4D, 4G, 8A, 8B, 8C, 8D, and 8E).
5) It is an even further object of the present invention to provide a three-dimensionally-adjustable three-dimensionally-alignable articulating spike system for securing a post,
   having a stanchion base.
   Therefore, the three-dimensionally-adjustable three-dimensionally-alignable articulating spike system for securing a post:
   a) Can have horizontal-angle-adjusting rotatable openings; and
      (FIGS. 3A, 3B, 3C, 4A, 4B, and 4C); and
   b) Can uniquely and horizontally, be rotatable and adjustable
      to be in line with other stanchion bases
      (FIGS. 4E, 4F, 4G, and 4H).
6) It is still yet another object of the present invention to provide a three-dimensionally-adjustable three-dimensionally-alignable articulating spike system for securing a post,
   having a stanchion base, which has:
   First post-elevating strut welded thereon for elevating and supporting a post bottom, to create an empty space between the post bottom and the stanchion base and the stanchion-securing bolt system (FIGS. 8C and 8D); and
   Second post-elevating strut welded thereon for elevating and supporting a post bottom, to create an empty space between the post bottom and the stanchion base and the stanchion-securing bolt system (FIGS. 8C and 8D).
   Therefore, the three-dimensionally-adjustable three-dimensionally-alignable articulating spike system for securing a post:
   a) Can allow rainwater to evaporate away from the post bottom (FIGS. 7A and 7C);
   b) Can keep the post bottom dry (FIG. 8B);
   c) Can prevent the post bottom from getting rotten (FIGS. 8B and 8D);
   d) Can allow rainwater to evaporate away from the stanchion base (FIGS. 7A, 7B, 7C, 8D, and 8E);
   e) Can keep the stanchion base dry (FIGS. 7A, 7B, 7C, 8A, 8B, 8C, 8D, and 8E);
   f) Can prevent the stanchion base from getting rusted (FIGS. 7A, 7B, 7C, 8A, 8B, 8C, 8D, and 8E);
   g) Can allow rainwater to evaporate away from the stanchion-securing bolt system (FIGS. 7A, 7C, and 8B);
   h) Can keep the stanchion-securing bolt system dry (FIG. 7C); and
   i) Can prevent the stanchion-securing bolt system from getting rusted (FIGS. 7A, 7B, 7C, 8A, 8B, 8C, 8D, and 8E).
7) It is still yet an even further object of the present invention to provide a three-dimensionally-adjustable three-dimensionally-alignable articulating spike system for securing a post,
   having a stanchion base, which has horizontal-angle-adjusting rotatable openings.
   Therefore, the three-dimensionally-adjustable three-dimensionally-alignable articulating spike system for securing a post:
   a) Can allow rain water to evaporate away from the post bottom (FIGS. 7A and 7C);

b) Can keep the post bottom dry (FIG. 8B);

c) Can prevent the post bottom from getting rotten (FIGS. 8B and 8D);

d) Can allow rain water to evaporate away from the stanchion base (FIGS. 7A, 7B, 7C, 8D, and 8E);

e) Can keep the stanchion base dry (FIGS. 7A, 7B, 7C, 8A, 8B, 8C, 8D, and 8E);

f) Can prevent the stanchion base from getting rusted (FIGS. 7A, 7B, 7C, 8A, 8B, 8C, 8D, and 8E);

g) Can allow rain water to evaporate away from the stanchion-securing bolt system (FIGS. 7A, 7C, and 8B);

h) Can keep the stanchion-securing bolt system dry (FIG. 7C); and i) Can prevent the stanchion-securing bolt system from getting rusted (FIGS. 7A, 7B, 7C, 8A, 8B, 8C, 8D, and 8E).

8) It is still yet an even further object of the present invention to provide a three-dimensionally-adjustable three-dimensionally-alignable articulating spike system for securing a post, having a ground-penetrating system, which has:

Multiple spiral locking blades for piercing through the ground to create empty tracks behind; and Multiple offset spiral locking shovels for shoveling the soil into the empty tracks made by the multiple spiral locking blades, to fill them up with soil to lock the multiple spiral locking blades in the ground.

Figure 2:
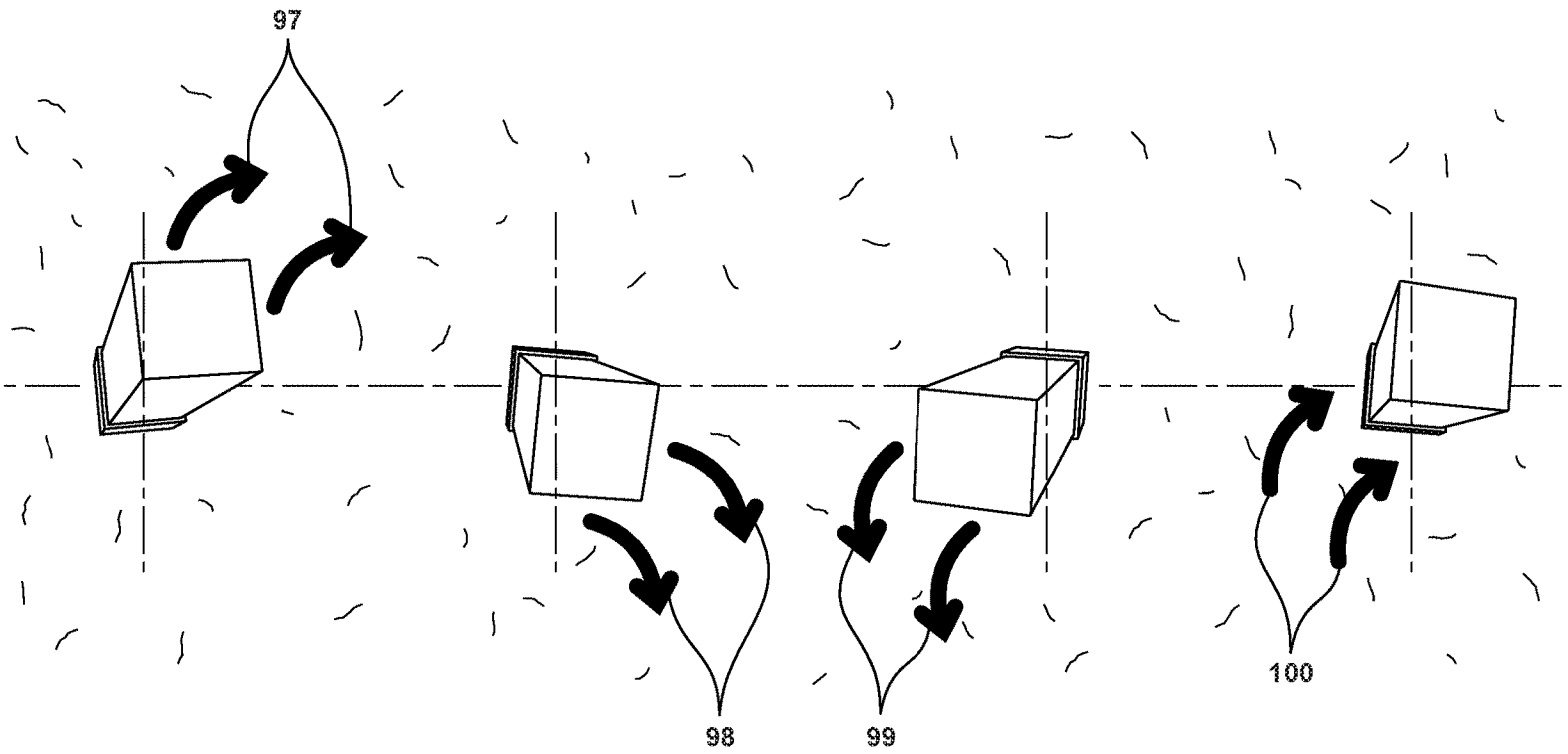
Fig. 2 (Prior Art)
Figure 3A:
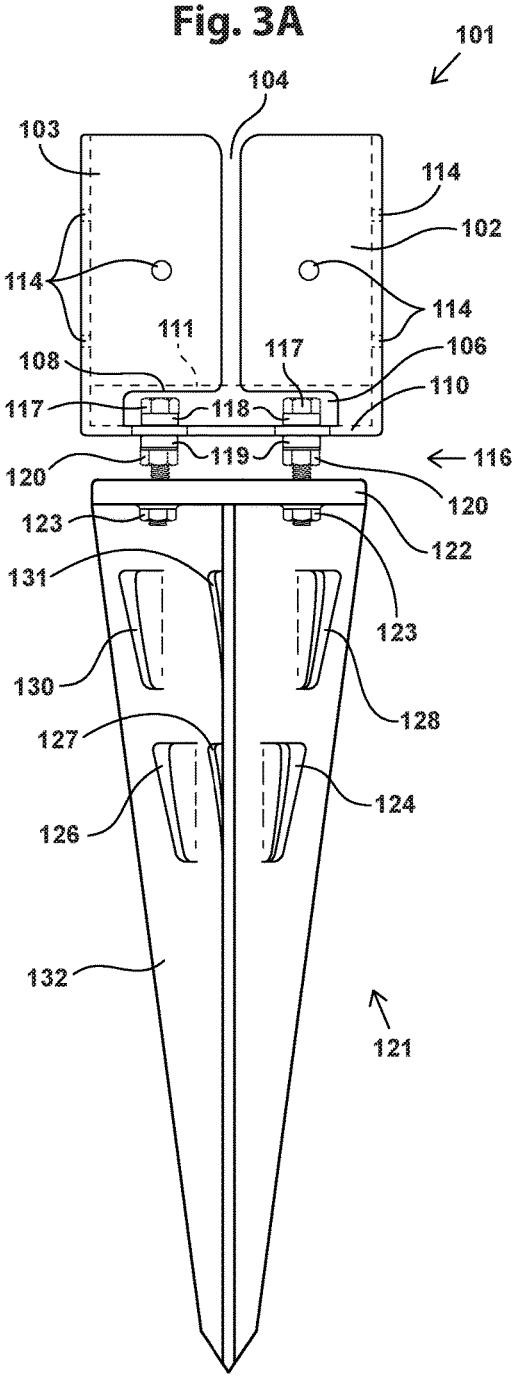
FIG. 3A to FIG. 3C illustrate front, top, and bottom views of a three-dimensionally-adjustable three-dimensionally-alignable post-securing stanchion system, a three-dimensionally-adjustable three-dimensionally-alignable stanchion-securing bolt system, and a multi-spiral-locking-blade multi-offset-spiral-locking-shovel ground-penetrating system.
Figure 3B:
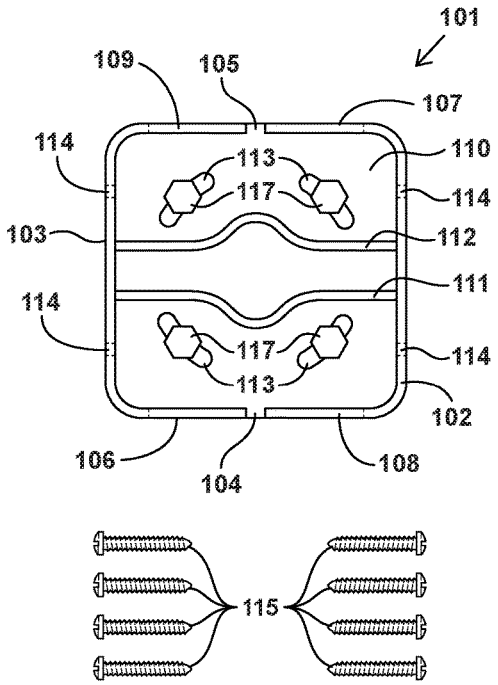
Figure 3C:
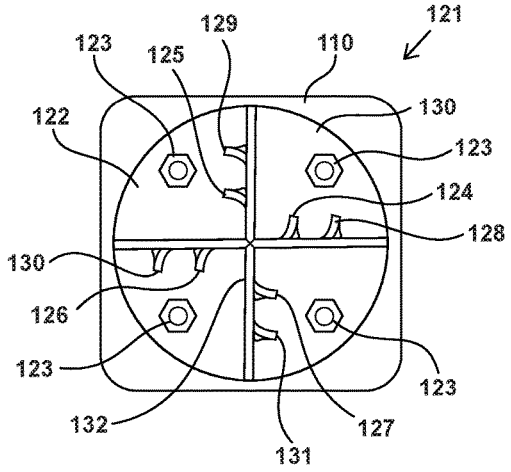
Figure 4A:
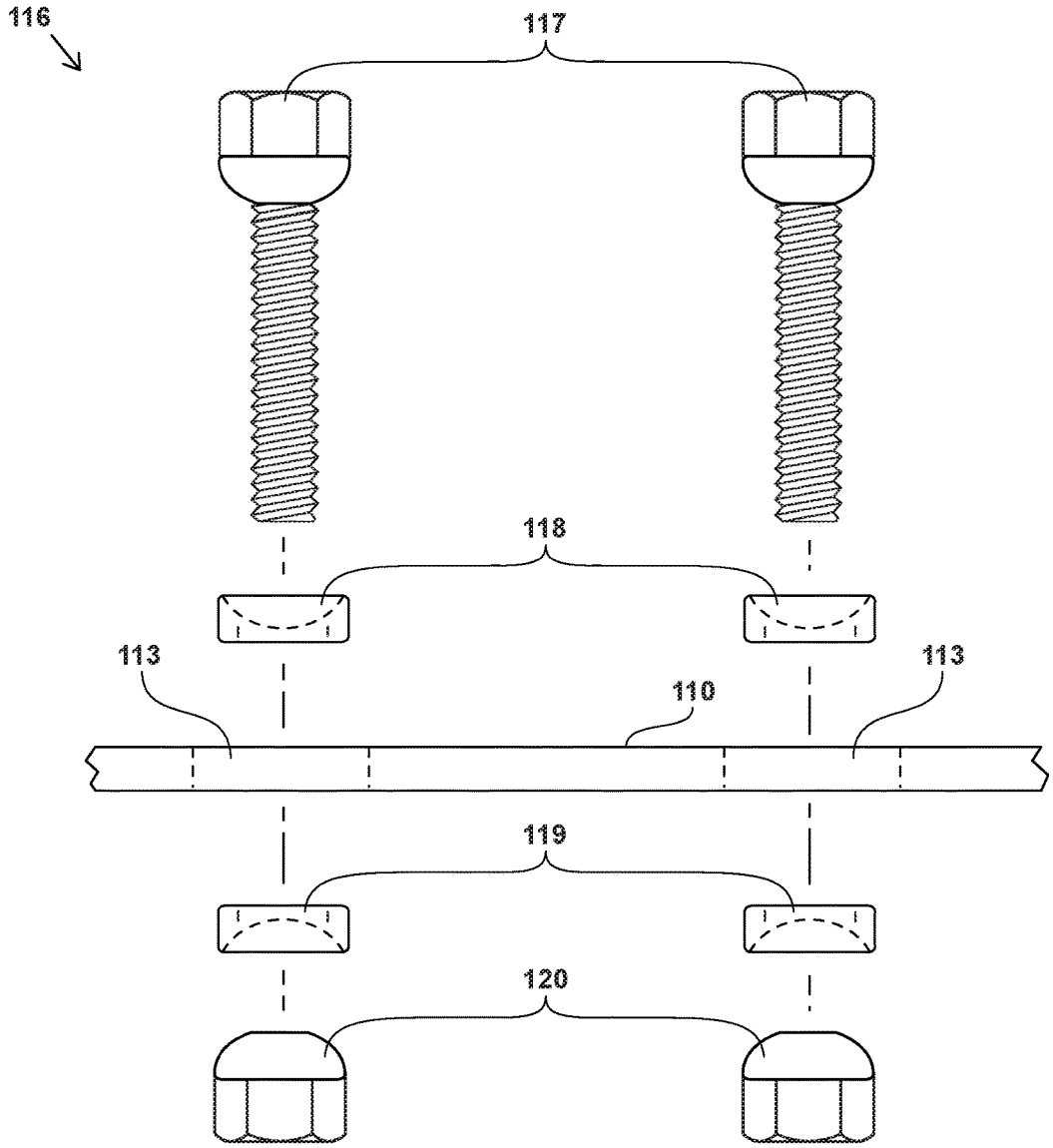
FIG. 4A to FIG. 4B illustrate exploded and front views of a three-dimensionally-adjustable three-dimensionally-alignable stanchion-securing bolt system, and how it works.
Figure 4B:
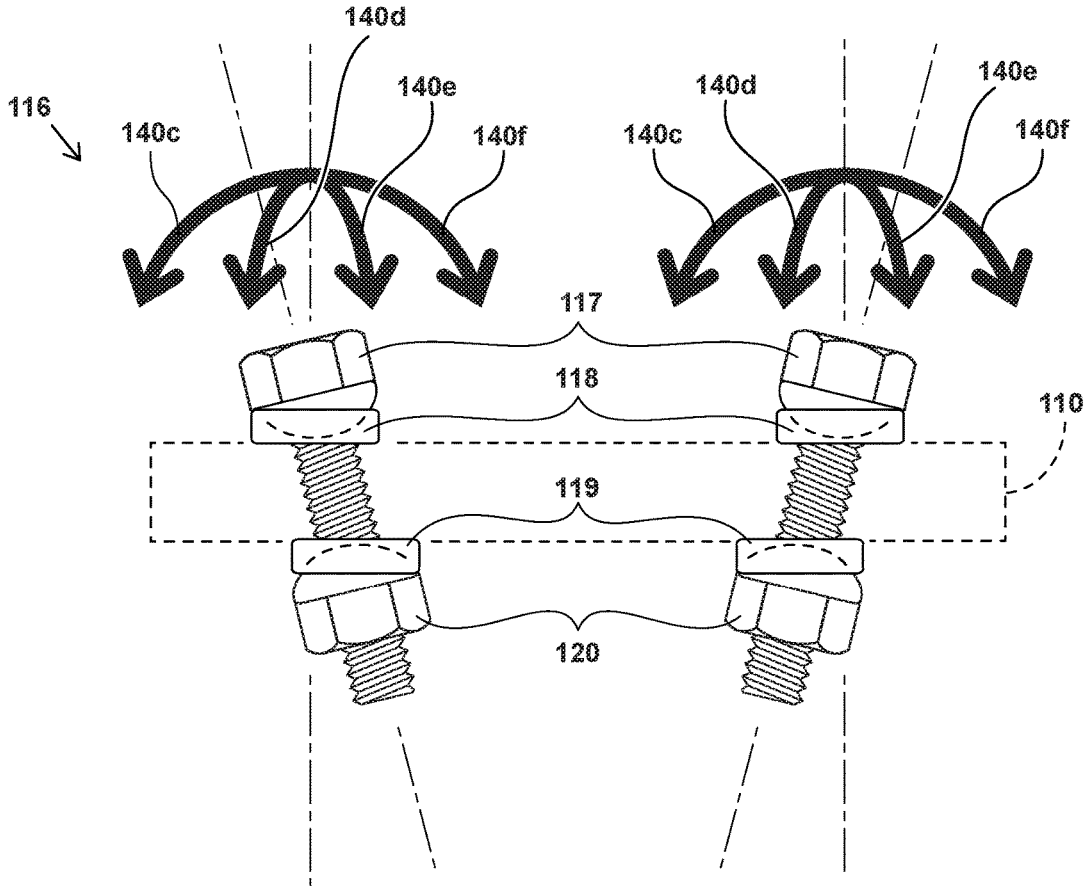
Figure 4C:
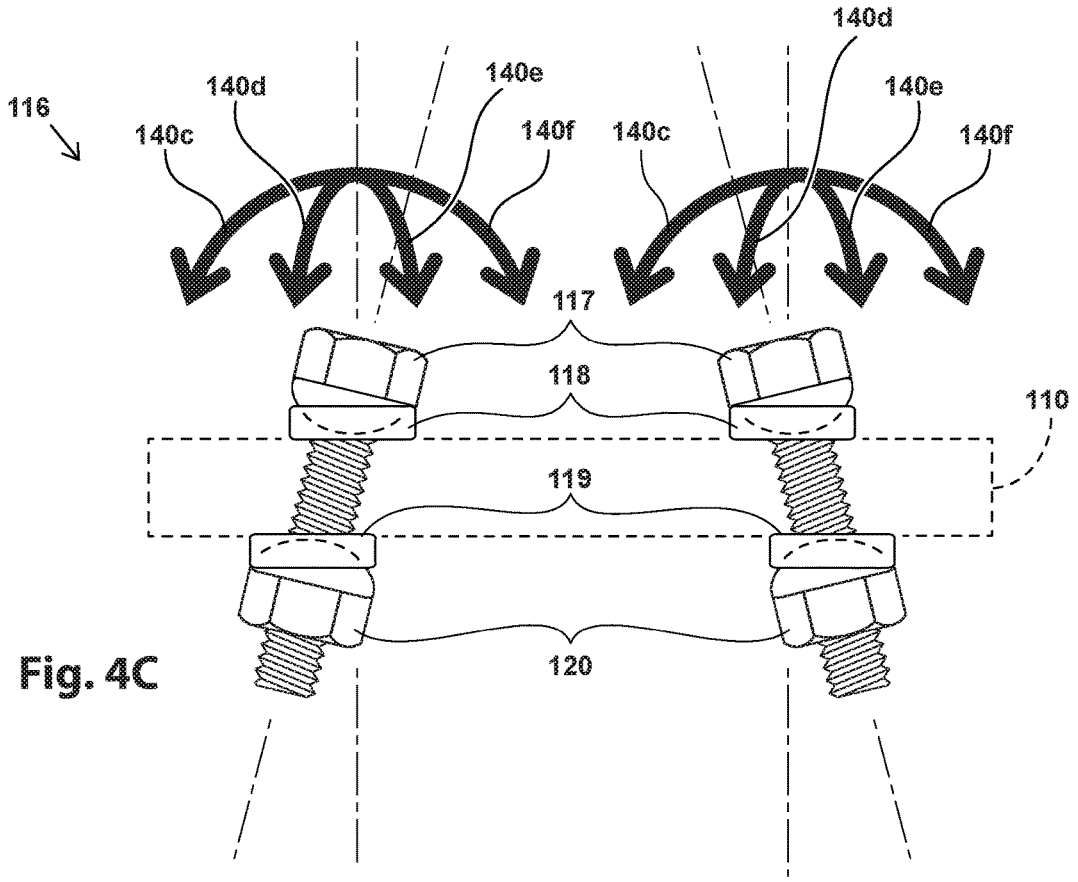
FIG. 4C illustrates a front view of a rust-preventing stanchion-covering system.
Figure 4D:
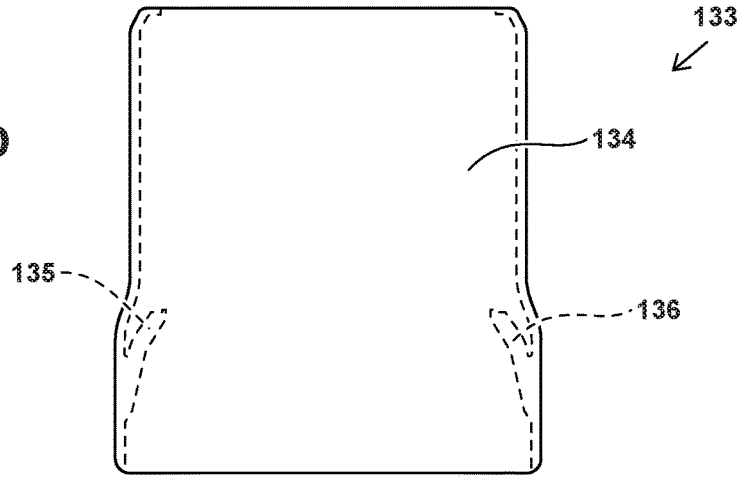
FIG. 4D to FIG. 4H illustrate front views of a three-dimensionally-adjustable three-dimensionally-alignable post-securing stanchion system, a three-dimensionally-adjustable three-dimensionally-alignable stanchion-securing bolt system, and a multi-spiral-locking-blade multi-offset-spiral-locking-shovel ground-penetrating system, and how they work together to secure a post in a 90-degree upright position.
Figure 4E:
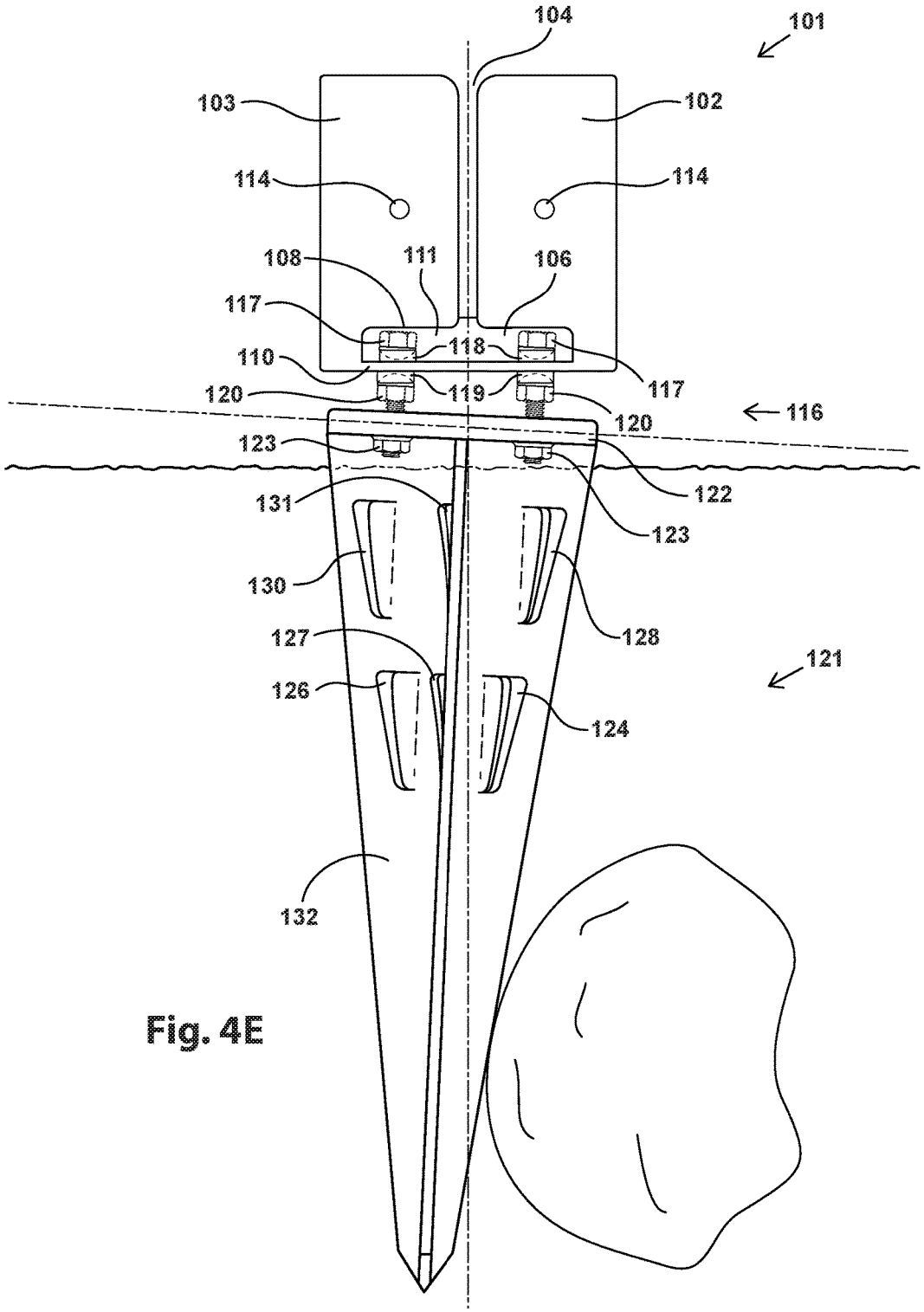
Figure 4F:
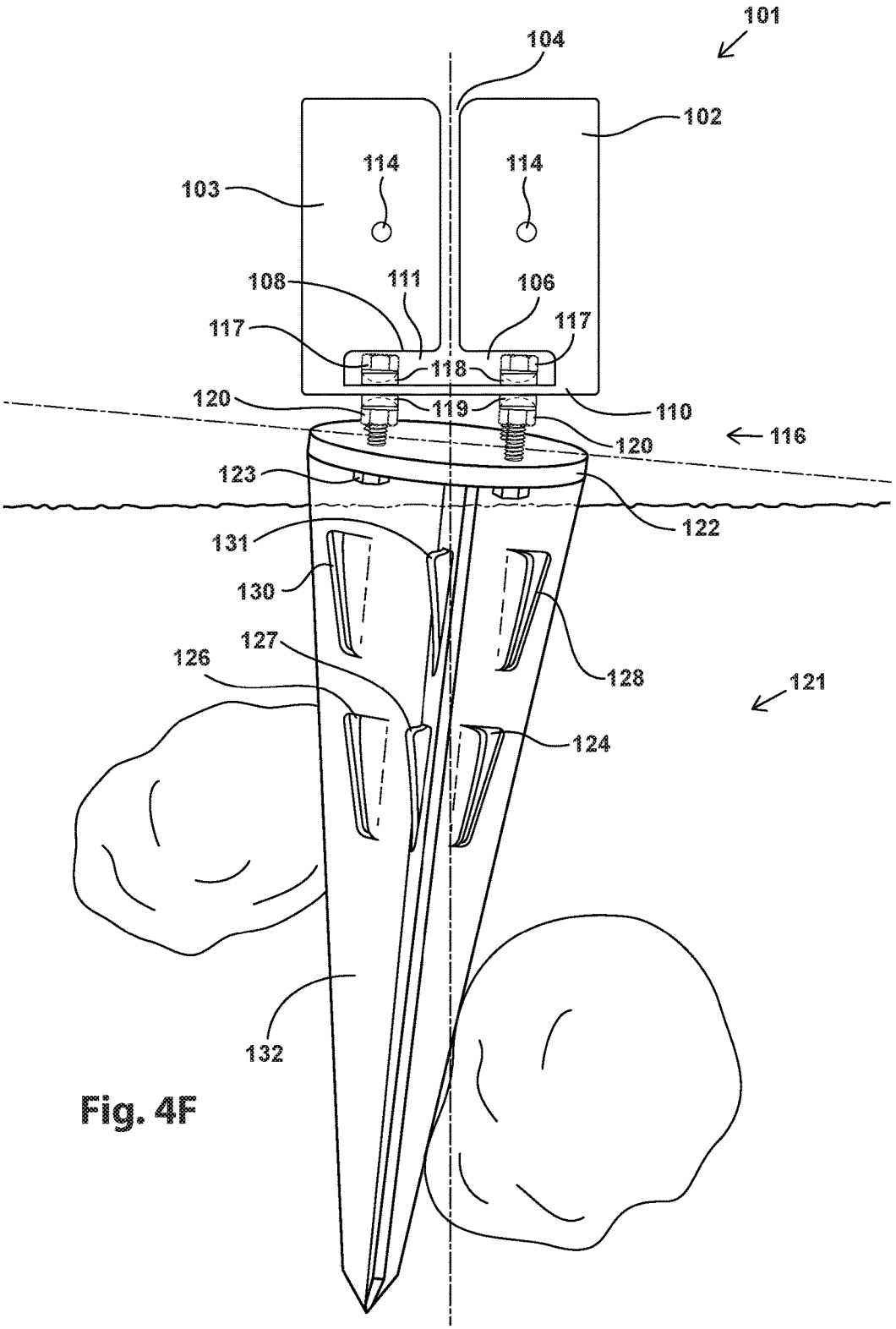
Figure 4G:
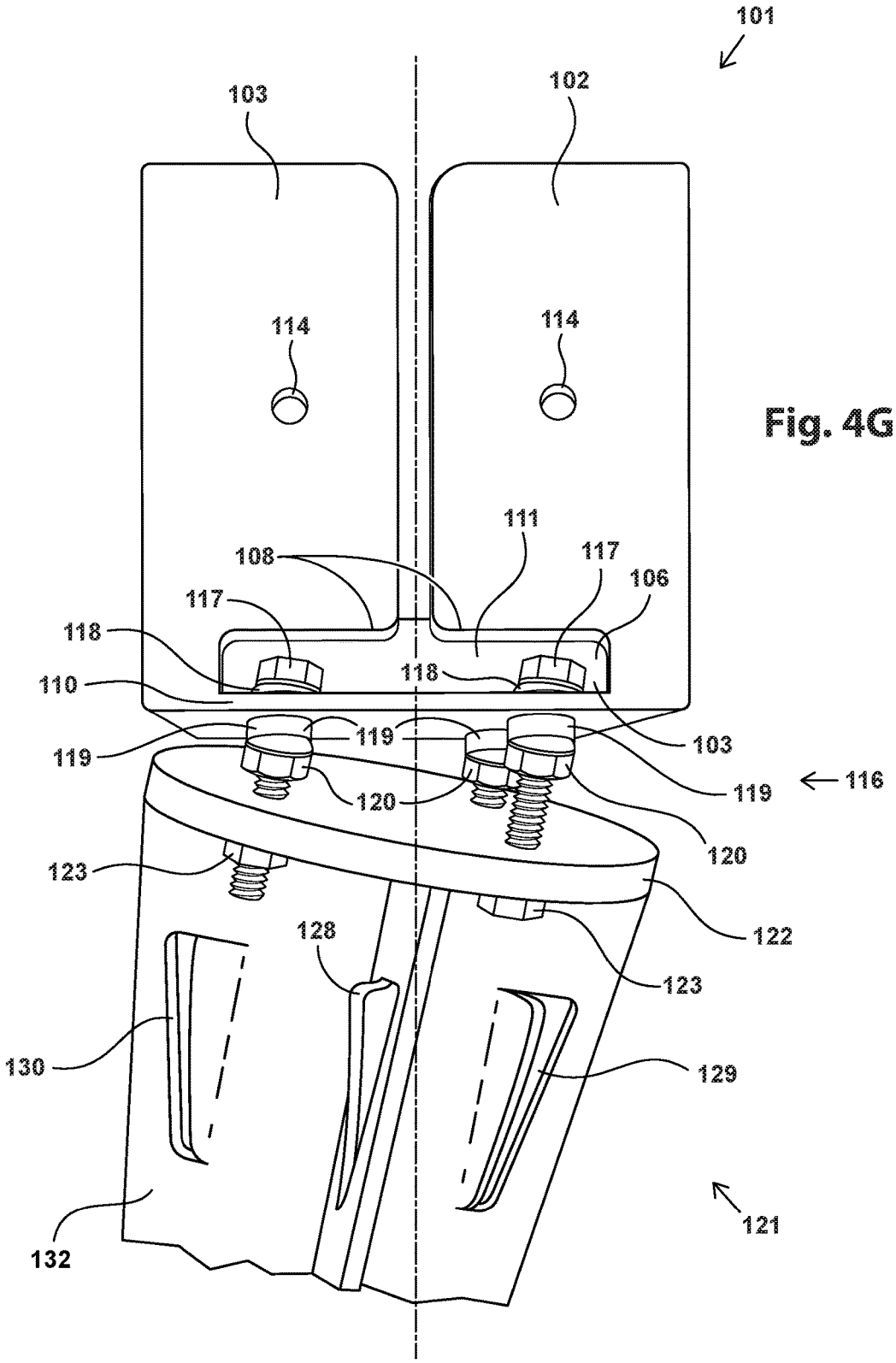
Figure 4H:
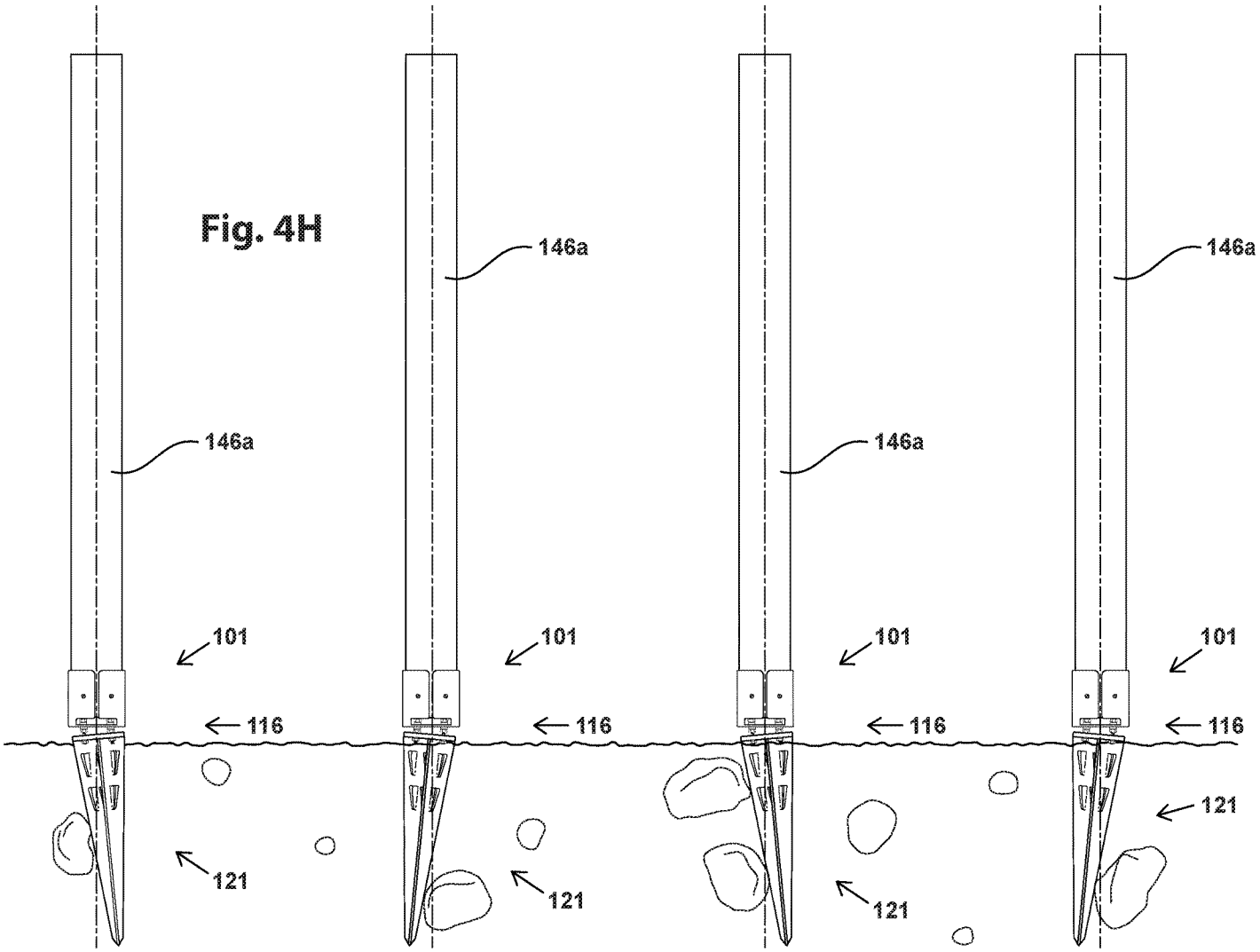

Therefore, the three-dimensionally-adjustable three-dimensionally-alignable articulating spike system for securing a post:

a) Can uniquely and securely, lock the three-dimensionally-adjustable three-dimensionally-alignable articulating spike system in the ground (FIGS. 4E, 4F, and 4H);

b) Can uniquely and securely, lock the three-dimensionally-adjustable three-dimensionally-alignable articulating spike system into a sandy ground surface (FIGS. 5A, 5B, 5C, 5D, and 5E);

c) Can uniquely and securely, lock the three-dimensionally-adjustable three-dimensionally-alignable articulating spike system into a gravel surface (FIGS. 5A, 5B, 5C, 5D, 5E and 5D);

d) Can uniquely and securely, lock the three-dimensionally-adjustable three-dimensionally-alignable articulating spike system into a rocky surface (FIGS. 5A, 5B, 5C, 5D, 5E and 5D);

e) Can uniquely and securely, lock the three-dimensionally-adjustable three-dimensionally-alignable articulating spike system into an uneven surface (FIGS. 4B, 4C, 4F, 4G, and 4H);

f) Can uniquely and securely, lock the three-dimensionally-adjustable three-dimensionally-alignable articulating spike system into an angled surface (FIGS. 4B, 4C, 4F, 4G, and 4H);

g) Can uniquely and securely, lock the three-dimensionally-adjustable three-dimensionally-alignable articulating spike system into a ground surface having submerged, inconsistent rocks (FIGS. 1 Prior Art, 4E, 4F, and 4G); and h) Can uniquely and securely, lock the three-dimensionally-adjustable three-dimensionally-alignable articulating spike system into a ground surface having submerged roots (FIGS. 1 Prior Art, 4E, 4F, and 4G).

9) It is still yet an even further object of the present invention to provide a three-dimensionally-adjustable three-dimensionally-alignable articulating spike system for securing a post, having convex locking bolts.

Therefore, the three-dimensionally-adjustable three-dimensionally-alignable articulating spike system for securing a post:

a) Can three-dimensionally adjust and align within one three-dimensionally-adjustable three-dimensionally-alignable concave upper washer (FIGS. 4A, 4B, 4C, 4E, 4F, and 4G);

b) Can connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can lock the three-dimensionally-adjustable three-dimensionally-alignable articulating spike system in the ground (FIGS. 3A, 4A, 4B, 4C, 4E, 4F, and 4G).

10) It is still yet an even further object of the present invention to provide a three-dimensionally-adjustable three-dimensionally-alignable articulating spike system for securing a post, having convex locking nuts.

Therefore, the three-dimensionally-adjustable three-dimensionally-alignable articulating spike system for securing a post:

a) Can three-dimensionally adjust and align within one three-dimensionally-adjustable three-dimensionally-alignable concave upper washer (FIGS. 4A, 4B, 4C, 4E, 4F, and 4G);

b) Can connect and lock one three-dimensionally-adjustable three-dimensionally-alignable concave upper washer, one three-dimensionally-adjustable three-dimensionally-alignable concave lower washer, and one three-dimensionally adjustable three-dimensionally-alignable convex locking nut, securely in a fixed position (FIGS. 3A, 4A, 4B, 4C, 4E, 4F, and 4G);

c) Can connect and lock three-dimensionally-adjustable three-dimensionally-alignable stanchion base to stanchion-securing hammer plate, securely in a fixed position (FIGS. 4A, 4B, 4C, 4E, 4F, and 4G); and d) Can lock the three-dimensionally-adjustable three-dimensionally-alignable articulating spike system in the ground (FIGS. 3A, 4A, 4B, 4C, 4E, 4F, 6A, 6B, and 6C).

11) It is still yet an even further object of the present invention to provide a three-dimensionally-adjustable three-dimensionally-alignable articulating spike system for securing a post, having a first spiral locking blade.

Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);
h) Can uniquely, spirally lock the three-dimensionally-adjustable three-dimensionally-alignable articulating spike system into a angled surface
(FIGS. 4E, 4F, 4G, and 4H);
i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can uniquely, spirally lock the three-dimensionally-adjustable three-dimensionally-alignable articulating spike system into a ground surface having submerged roots
(FIGS. 4E, 4F, 4G, and 4H).

12) It is still yet an even further object of the present invention to provide a three-dimensionally-adjustable three-dimensionally-alignable articulating spike system for securing a post,
having a second spiral locking blade.
Therefore, the three-dimensionally-adjustable three-dimensionally-alignable articulating spike system for securing a post:
a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);
h) Can uniquely, spirally lock the three-dimensionally-adjustable three-dimensionally-alignable articulating spike system into a angled surface
(FIGS. 4E, 4F, 4G, and 4H);
i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and
j) Can uniquely, spirally lock the three-dimensionally-adjustable three-dimensionally-alignable articulating spike system into a ground surface having submerged roots
(FIGS. 4E, 4F, 4G, and 4H).

13) It is still yet an even further object of the present invention to provide a three-dimensionally-adjustable three-dimensionally-alignable articulating spike system for securing a post,
having a third spiral locking blade.
Therefore, the three-dimensionally-adjustable three-dimensionally-alignable articulating spike system for securing a post:
a) Can spirally shovel soil into the piercing track made by first spiral locking blade to fill the piercing track up with soil to lock first spiral locking blade in the ground
(FIGS. 5A, 5B, 5C, 5D, 5E, and 5F);
b) Can spirally lock multi-spiral-locking-blade multi-offset-spiral-locking-shovel ground penetrating system in the ground
(FIGS. 4E, 4F, 4G, 4H, 5B, 5C, 5D, and 5E);
c) Can lock the three-dimensionally-adjustable three-dimensionally-alignable articulating spike system in the ground
(FIGS. 4B, 4C, 4F, 4G, and 4H);
d) Can uniquely, spirally lock the three-dimensionally-adjustable three-dimensionally-alignable articulating spike system into a sandy ground surface
(FIGS. 5A, 5B, 5C, 5D, 5E, and 5F);
e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);
f) Can uniquely, spirally lock the three-dimensionally-adjustable three-dimensionally-alignable articulating spike system into a rocky surface
(FIGS. 4E, 4F, 4G, 4H, 6A, 6B, and 6C);
g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

14) It is still yet an even further object of the present invention to provide a three-dimensionally-adjustable three-dimensionally-alignable articulating spike system for securing a post,
having a fourth spiral locking blade.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

15) It is still yet an even further object of the present invention to provide a three-dimensionally-adjustable three-dimensionally-alignable articulating spike system for securing a post,
having a first offset spiral locking shovel.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

16) It is still yet an even further object of the present invention to provide a three-dimensionally-adjustable three-dimensionally-alignable articulating spike system for securing a post,
having second offset spiral locking shovel.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

17) It is still yet an even further object of the present invention to provide a three-dimensionally-adjustable three-dimensionally-alignable articulating spike system for securing a post,
having third offset spiral locking shovel.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks
(FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots
(FIGS. 4E, 4F, 4G, and 4H).

18) It is still yet an even further object of the present invention to provide a three-dimensionally-adjustable three-dimensionally-alignable articulating spike system for securing a post,
having fourth offset spiral locking shovel.
Therefore, the three-dimensionally-adjustable three-dimensionally-alignable articulating spike system for securing a post:

a) Can spirally shovel soil into the piercing track made by first spiral locking blade to fill the piercing track up with soil to lock first spiral locking blade in the ground
(FIGS. 5A, 5B, 5C, 5D, 5E, and 5F);

b) Can spirally lock multi-spiral-locking-blade multi-offset-spiral-locking-shovel ground penetrating system in the ground
(FIGS. 4E, 4F, 4G, 4H, 5B, 5C, 5D, and 5E);

c) Can lock the three-dimensionally-adjustable three-dimensionally-alignable articulating spike system in the ground
(FIGS. 4B, 4C, 4F, 4G, and 4H);

d) Can uniquely, spirally lock the three-dimensionally-adjustable three-dimensionally-alignable articulating spike system into a sandy ground surface
(FIGS. 5A, 5B, 5C, 5D, 5E, and 5F);

e) Can uniquely, spirally lock the three-dimensionally-adjustable three-dimensionally-alignable articulating spike system into a gravel surface
(FIGS. 4E, 4F, 4G, 4H, 5A, 6A, 6B, and 6C);

f) Can uniquely, spirally lock the three-dimensionally-adjustable three-dimensionally-alignable articulating spike system into a rocky surface
(FIGS. 4E, 4F, 4G, 4H, 6A, 6B, and 6C);

g) Can uniquely, spirally lock the three-dimensionally-adjustable three-dimensionally-alignable articulating spike system into a uneven surface
(FIGS. 4B, 4C, 4E, 4F, 4G, and 4H);

h) Can uniquely, spirally lock the three-dimensionally-adjustable three-dimensionally-alignable articulating spike system into a angled surface
(FIGS. 4E, 4F, 4G, and 4H);

i) Can uniquely, spirally lock the three-dimensionally-adjustable three-dimensionally-alignable articulating spike system into a ground surface having submerged, inconsistent rocks (FIGS. 4E, 4F, 4G, 4H, 6A, 6B, and 6C); and j) Can uniquely, spirally lock the three-dimensionally-adjustable three-dimensionally-alignable articulating spike system into a ground surface having submerged roots (FIGS. 4E, 4F, 4G, and 4H).

What is claimed is:

1. A three-dimensionally-adjustable spike system for securing a post comprising:

a three-dimensionally-adjustable post-securing stanchion system comprising:

a first three-dimensionally-adjustable C-shaped wall, a second three-dimensionally-adjustable C-shaped wall, a first wrench accessible opening formed in and between said first and said second three-dimensionally-adjustable C-shaped walls, a second wrench accessible opening formed in and between said first and said second three-dimensionally-adjustable C-shaped walls, a three-dimensionally-adjustable stanchion base molded to said first and said second three-dimensionally-adjustable C-shaped walls, a first post-elevating strut welded to said three-dimensionally-adjustable stanchion base, a second post-elevating strut welded to said three-dimensionally-adjustable stanchion base, a plurality of bolt holes drilled in said three-dimensionally-adjustable stanchion base, a plurality of screw holes drilled in said first and said second three-dimensionally-adjustable C-shaped walls, and a plurality of post-clamping screws for being screwed into said screw holes and said post;

a three-dimensionally-adjustable stanchion-securing bolt system comprising:

a plurality of three-dimensionally-adjustable convex locking bolts each having a convex bolt bottom for being inserted through said bolt holes, a plurality of three-dimensionally-adjustable concave upper washers each having an upper concave surface engaging with said convex bolt bottom for three-dimensionally adjusting said three-dimensionally-adjustable stanchion base, a plurality of three-dimensionally-adjustable concave lower washers each having a lower concave surface for three-dimensionally adjusting said three-dimensionally-adjustable stanchion base, and a plurality of three-dimensionally-adjustable convex locking nuts each having a convex nut top engaging with said lower concave surface for three-dimensionally adjusting and securing said convex locking bolts, said concave upper washers, said concave lower washers, and said three-dimensionally-adjustable stanchion base together; and a multi-spiral-blade multi-offset-spiral-shovel ground-penetrating system comprising:

a stanchion-securing hammer plate, a plurality of plate holes drilled in said stanchion-securing hammer plate for said three-dimensionally-adjustable convex locking bolts to be inserted therethrough, a plurality of stationary hammer-plate nuts welded to said stanchion-securing hammer plate for stationarily securing said three-dimensionally-adjustable convex locking bolts to said stanchion-securing hammer plate, a plurality of spiral blades spirally molded to said stanchion-securing hammer plate for spirally piercing the ground and spirally opening a track therein, a plurality of offset spiral shovels spirally and offsettingly molded to said stanchion-securing hammer plate for spirally and offsettingly closing said track, and a ground-penetrating X-cross-sectional spike welded to said stanchion-securing hammer plate, said spiral blades, and said offset spiral shovels, whereby said three-dimensionally-adjustable spike system:

can three-dimensionally adjustably secure said three-dimensionally-adjustable stanchion base to the ground using said three-dimensionally-adjustable convex locking nuts, can stationarily secure said three-dimensionally-adjustable stanchion base to the ground using said stationary hammer-plate nuts, can be three-dimensionally adjustable and lockable before, during, and after installation using said three-dimensionally-adjustable convex locking bolts, said three-dimensionally-adjustable concave upper washers, said three-dimensionally-adjustable concave lower washers, and said three-dimensionally-adjustable convex locking nuts to prevent said first and said second three-dimensionally-adjustable C-shaped walls from leaning, warping, and twisting, can be three-dimensionally adjustable and lockable before, during, and after installation using said three-dimensionally-adjustable convex locking bolts, said three-dimensionally-adjustable concave upper washers, said three-dimensionally-adjustable concave lower washers, and said three-dimensionally-adjustable convex locking nuts to prevent said three-dimensionally-adjustable stanchion base from leaning, warping, and twisting, can allow vertical access between said first and said second three-dimensionally-adjustable C-shaped walls to three-dimensionally adjust and secure said three-dimensionally-adjustable stanchion base, can allow horizontal access through said first and said second wrench accessible openings to three-dimensionally adjust and secure said three-dimensionally-adjustable stanchion base, can allow rain water to evaporate away through said first and said second wrench accessible openings to prevent said three-dimensionally-adjustable stanchion base and said first and said second post-elevating struts from getting rusted, can spirally piercing the ground and spirally opening said track, using said spiral blades, and can spirally and offsettingly closing said track using said offset spiral shovels.

2. The three-dimensionally-adjustable spike system of claim 1, wherein said three-dimensionally-adjustable convex locking bolts, said three-dimensionally-adjustable concave upper washers, said three-dimensionally-adjustable concave lower washers, and said three-dimensionally-adjustable convex locking nuts three-dimensionally adjustably secure said post perpendicularly to the ground before, during, and after installation, and wherein said stationary hammer-plate nuts stationarily secure said post perpendicularly to the ground before, during, and after installation.

3. The three-dimensionally-adjustable spike system of claim 1, further comprising:

a rust-preventing cover for covering and preventing said first and said second three-dimensionally-adjustable C-shaped walls and said three-dimensionally-adjustable stanchion base from rusting, a first snap-lock molded to said rust-preventing cover for being snap-hooked on said first three-dimensionally-adjustable C-shaped walls, and a second snap-lock molded to said rust-preventing cover for being snap-hooked on said second three-dimensionally-adjustable C-shaped walls.

4. The three-dimensionally-adjustable spike of claim 1, wherein said first and said second wrench-accessable openings each have a rectangular shape.

5. The three-dimensionally-adjustable spike system of claim 1, wherein said three-dimensionally-adjustable convex locking bolts has a hexagonal head.

6. The three-dimensionally-adjustable spike system of claim 1, wherein said three-dimensionally-adjustable convex locking bolts has a pentagonal head.

7. The three-dimensionally-adjustable spike system of claim 1, wherein said three-dimensionally-adjustable convex locking bolts has a square or Allen head.

8. The three-dimensionally-adjustable spike system of claim 1, wherein said spiral blades are disposed near said offset spiral shovels.

9. The three-dimensionally-adjustable spike system of claim 1, with wherein said spiral blades are disposed below said offset spiral shovels.

10. A three-dimensionally-adjustable spike for securing a post comprising:

a three-dimensionally-adjustable post-securing stanchion system comprising:

a first three-dimensionally-adjustable C-shaped wall, a second three-dimensionally-adjustable C-shaped wall, a first wrench-accessible opening formed in and between said first and said second three-dimensionally-adjustable C-shaped walls, a second wrench-accessible opening formed in and between said first and said second three-dimensionally-adjustable C-shaped walls, a three-dimensionally-adjustable stanchion base molded to said first and said second three-dimensionally-adjustable C-shaped walls, a plurality of bolt holes drilled in said three-dimensionally-adjustable stanchion base, a plurality of screw holes drilled in said first and said second three-dimensionally-adjustable C-shaped walls, and a plurality of post-clamping screws for being screwed into said screw holes and said post;

a three-dimensionally-adjustable stanchion-securing bolt system comprising:

a plurality of three-dimensionally-adjustable convex locking bolts each having a convex bolt bottom for being inserted through said bolt holes, a plurality of three-dimensionally-adjustable concave upper washers each having an upper concave surface engaging with said convex bolt bottom for three-dimensionally adjusting said three-dimensionally-adjustable stanchion base, a plurality of three-dimensionally-adjustable concave lower washers each having a lower concave surface for three-dimensionally adjusting said three-dimensionally-adjustable stanchion base, and a plurality of three-dimensionally-adjustable convex locking nuts each having a convex nut top engaging with said lower concave surface for three-dimensionally adjusting and securing said convex locking bolts, said concave upper washers, said concave lower washers, and said three-dimensionally-adjustable stanchion base together;

a multi-spiral-blade multi-offset-spiral-shovel ground-penetrating system comprising:

a stanchion-securing hammer plate, a plurality of plate holes drilled in said stanchion-securing hammer plate for said three-dimensionally-adjustable convex locking bolts to be inserted therethrough, a plurality of stationary hammer-plate nuts welded to said stanchion-securing hammer plate for stationarily securing said three-dimensionally-adjustable convex locking bolts to said stanchion-securing hammer plate, and a ground-penetrating spike welded to said stanchion-securing hammer plate; and a rust-preventing stanchion-covering system, comprising:

a rust-preventing cover for covering and preventing said first and said second three-dimensionally-adjustable C-shaped walls and said three-dimensionally-adjustable stanchion base from rusting, a first snap-lock molded to said rust-preventing cover for being snap-hooked on said first three-dimensionally-adjustable C-shaped walls, and a second snap-lock molded to said rust-preventing cover for being snap-hooked on said second three-dimensionally-adjustable C-shaped walls.

11. An adjustable spike for securing a post comprising:

a first wall;

a second wall;

a first wrench-accessible opening formed in and between said first and said second walls;

a second wrench-accessible opening formed in and between said first and said second walls;

a stanchion base molded to said first and said second walls;

a plurality of bolt holes drilled in said stanchion base;

a plurality of screw holes drilled in said first and said second walls;

a plurality of post-clamping screws for being screwed into said screw holes and said post;

a plurality of convex locking bolts each having a convex bolt bottom for being inserted through said bolt holes;

a plurality of concave upper washers each having an upper concave surface engaging with said convex bolt bottom for three-dimensionally adjusting said stanchion base;

a plurality of concave lower washers each having a lower concave surface for three-dimensionally adjusting said stanchion base;

a plurality of convex locking nuts each having a convex nut top engaging with said lower concave surface for three-dimensionally adjusting and securing said convex locking bolts, said concave upper washers, said concave lower washers, and said stanchion base together;

a hammer plate;

a plurality of plate holes drilled in said hammer plate for said convex locking bolts to be inserted therethrough;

a plurality of hammer-plate nuts welded to said hammer plate for stationarily securing said convex locking bolts to said hammer plate;

a spike welded to said hammer plate;

a rust-preventing cover for covering and preventing said first and said second walls and said stanchion base from rusting;

a first snap-lock molded to said rust-preventing cover for being snap-hooked on said first walls; and a second snap-lock molded to said rust-preventing cover for being snap-hooked on said second walls.

* * * * *